US008888257B2

(12) United States Patent
Matsumoto et al.

(10) Patent No.: US 8,888,257 B2
(45) Date of Patent: Nov. 18, 2014

(54) LIQUID DISCHARGE HEAD, LIQUID DISCHARGE DEVICE USING THE SAME, AND RECORDING APPARATUS

(75) Inventors: Ayumu Matsumoto, Kagoshima (JP); Daisuke Hozumi, Kagoshima (JP)
(73) Assignee: Kyocera Corporation, Kyoto (JP)

( * ) Notice: Subject to any disclaimer, the term of this patent is extended or adjusted under 35 U.S.C. 154(b) by 164 days.
(21) Appl. No.: 13/498,777
(22) PCT Filed: Oct. 28, 2010
(86) PCT No.: PCT/JP2010/069204
§ 371 (c)(1),
(2), (4) Date: Mar. 28, 2012
(87) PCT Pub. No.: WO2011/052691
PCT Pub. Date: May 5, 2011

(65) Prior Publication Data
US 2012/0188298 A1 Jul. 26, 2012

(30) Foreign Application Priority Data

| | | |
|---|---|---|
| Oct. 28, 2009 | (JP) | 2009-247309 |
| Oct. 28, 2009 | (JP) | 2009-247463 |
| Nov. 25, 2009 | (JP) | 2009-266961 |

(51) Int. Cl.

| | |
|---|---|
| ***B41J 2/175*** | (2006.01) |
| ***B41J 29/38*** | (2006.01) |
| ***B41J 2/17*** | (2006.01) |
| ***B41J 2/14*** | (2006.01) |

(52) U.S. Cl.
CPC .... *B41J 2/14209* (2013.01); *B41J 2002/14217* (2013.01); *B41J 2002/14225* (2013.01); *B41J 2002/14306* (2013.01); *B41J 2002/14419* (2013.01); *B41J 2002/14459* (2013.01); *B41J 2202/20* (2013.01)
USPC ..... 347/85; 347/6; 347/84

(58) Field of Classification Search
USPC ..... 347/6, 84, 85
See application file for complete search history.

(56) References Cited

U.S. PATENT DOCUMENTS

| | | | |
|---|---|---|---|
| 6,682,185 | B2 | 1/2004 | Hashimoto et al. |
| 2007/0200885 | A1 | 8/2007 | Hibi |
| 2008/0180500 | A1 | 7/2008 | Sugahara |
| 2009/0167821 | A1 | 7/2009 | Sugahara |
| 2009/0225138 | A1 | 9/2009 | Watanabe |

FOREIGN PATENT DOCUMENTS

| | | | |
|---|---|---|---|
| EP | 1547775 | A1 | 6/2005 |
| JP | 2000043253 | | 2/2000 |
| JP | 2002264329 | | 9/2002 |
| JP | 2002292868 | | 10/2002 |
| JP | 2003305852 | | 10/2003 |
| JP | 2005246663 | | 9/2005 |
| JP | 2007253618 | | 10/2007 |
| JP | 2008183800 | | 8/2008 |
| JP | 2009083276 | | 4/2009 |
| JP | 2009160798 | | 7/2009 |
| JP | 2009226943 | | 10/2009 |

OTHER PUBLICATIONS

Extended European Search Report, EP 10826823, May 15, 2013, 6 pp.

*Primary Examiner* — Jannelle M Lebron
(74) *Attorney, Agent, or Firm* — Volpe and Koenig, P.C.

(57) ABSTRACT

Providing is a liquid discharge head less susceptible to a standing wave occurred in a shared flow path; a liquid discharge device using the liquid discharge head; and a recording apparatus. The liquid discharge head includes a plurality of liquid discharge pores; a plurality of liquid pressing chambers 210 respectively connected to the plurality of liquid discharge pores; a shared flow path 205*a* being long in one direction and being linked the plurality of liquid pressing chambers 210; a liquid supply path 205*c* which is connected to both ends of the shared flow path 205*a*, and has a larger cross-sectional area than the shared flow path 205*a*; and a plurality of pressing parts for respectively pressing liquid in the plurality of liquid pressing chambers 10. The cross-sectional area of a middle segment of the shared flow path 205*a* is smaller than the cross-sectional area of that of each of both end segments thereof.

8 Claims, 20 Drawing Sheets

(a)

(b)

(a) Discharge Speed from Liquid Discharge Pore connected to One Submanifold (Share Flow Path) (Sample No.101)

(b) Discharge Speed from Liquid Discharge Pore connected to One Submanifold (Share Flow Path) (Sample No.102)

(a)

(b)

(a)

(b)

(c)

LIQUID DISCHARGE HEAD, LIQUID DISCHARGE DEVICE USING THE SAME, AND RECORDING APPARATUS

TECHNICAL FIELD

The present invention relates to a liquid discharge head for discharging liquid drops, a liquid discharge device using the liquid discharge head, and a recording apparatus for printing images by using the liquid discharge device.

BACKGROUND ART

Recently, printing apparatuses using inkjet recording method, such as inkjet printers and inkjet plotters, have been widely used in not only printers for general consumers, but also industrial purposes, such as manufacturing of color filters for forming electronic circuits and for liquid crystal displays, and manufacturing of organic EL displays.

In the printing apparatus using the inkjet method, liquid discharge heads for discharging liquid are mounted as a printing head. For this type of print heads, thermal head method and piezoelectric method are generally known. That is, in the thermal head method, a heater as a pressing means is installed in an ink path filled with ink, and the ink is heated and boiled by the heater. The ink is discharged as liquid drops through an ink discharge pore by pressing the ink with air bubbles generated in the ink path. In the piezoelectric method, ink is discharged as liquid drops through the ink discharge pore by subjecting a part of the wall of the ink path filled with the ink to bending displacement by a displacement element, thereby mechanically pressing the ink in the ink path.

The liquid discharge head can be classified into serial method in which recording is carried out while moving the liquid discharge head in a direction (main scanning direction) orthogonal to a transport direction of a recording medium (sub scanning direction); and line method in which recording is carried out on a recording medium transported in the sub scanning direction in a state where the liquid discharge head being longer in the main scanning direction than the recording medium is fixed. The line method has an advantage of permitting high speed recording because unlike the serial method, there is no need to move the liquid discharge head.

Even with the liquid discharge head of either the serial method or the line method, it is necessary to increase the density of the liquid discharge pores for discharging the liquid drops which are formed in the liquid discharge head, in order to print the liquid drops with high density.

For example, there is known a liquid discharge head constructed by stacking a path member with a manifold (shared flow path) and liquid discharge pores respectively connected to the manifold through a plurality of liquid pressing chambers; and an actuator unit with a plurality of displacement elements which are respectively disposed to cover the liquid pressing chambers (refer to, for example, patent document 1). In this liquid discharge head, the liquid pressing chambers respectively connected to the plurality of liquid discharge pores are arranged in a matrix shape, and the ink is discharged from the individual liquid discharge pores by displacing the displacement elements of the actuator unit disposed to cover the liquid discharge chambers, thus permitting printing at a resolution of 600 dpi in the main scanning direction.

PRIOR ART DOCUMENT

Patent Document

Patent document 1: Japanese Unexamined Patent Publication No. 2003-305852.

SUMMARY OF THE INVENTION

Problems to be Solved by the Invention

However, in the liquid discharge head as described in the patent document 1, for example, attempts to increase a driving frequency for driving the displacement element, attempts to increase the displacement of the displacement element, attempts to decrease the distance between the liquid pressing chambers connected to a shared flow path in order to further enhance resolution, or attempts to decrease the cross-sectional area of the shared flow path for the purpose of miniaturization may involve the following risk. That is, the pressure applied to the liquid in the liquid pressing chambers is transferred to the shared flow path, and the liquid in the shared flow path resonates therewith, and a standing wave occurs in the shared flow path.

The occurrence of the standing wave may involve a risk that the pressure thereof is transferred to the liquid pressing chambers, thus fluctuating discharge characteristics. In particular, there is a risk that the discharge characteristics fluctuations caused by the influence of the standing wave may become periodic, and influence periodically appears on images when used for printing, and the influence becomes remarkable.

Therefore, an object of the present invention is to provide a liquid discharge head less susceptible to the influence of the standing wave occurred in the shared flow path, and a liquid discharge device using the liquid discharge head, and a recording apparatus.

Means for Solving the Problems

A liquid discharge head of the present invention includes a shared flow path being long in one direction; a plurality of liquid discharge pores respectively connected to a midway of the shared flow path through a plurality of liquid pressing chambers; a liquid supply path which is connected to both ends of the shared flow path, and has a larger cross-sectional area than the shared flow path; and a plurality of pressing parts for respectively pressing liquid in the plurality of liquid pressing chambers. A cross-sectional area of a middle segment of the shared flow path is smaller than a cross-sectional area of each of both end segments thereof.

In the liquid discharge head, when a length of the shared flow path is taken as L (mm), an average cross-sectional area of a segment of a length L/2 in a middle of the shared flow path is preferably a half or less of an average cross-sectional area of a segment of a length L/4 from the both ends of the shared flow path.

Alternatively, a liquid discharge head of the present invention includes a shared flow path which is long in one direction and is closed at one end thereof; a liquid supply path which is connected to the other end of the shared flow path, and has a larger cross-sectional area than the shared flow path; a plurality of liquid discharge pores respectively connected to a midway of the shared flow path through a plurality of liquid pressing chambers; and a plurality of pressing parts for respectively pressing liquid in the plurality of liquid pressing chambers. A cross-sectional area of a segment at the one end of the shared flow path is smaller than a cross-sectional area of a segment at the other end.

In the liquid discharge head, when a length of the shared flow path is taken as L (mm), an average cross-sectional area of a segment of a length L/2 from the one end of the shared flow path is preferably a half or less of an average cross-sectional area of a segment of a length L/2 from the other end of the shared flow path.

Alternatively, a liquid discharge head of the present invention includes a shared flow path which is long in one direction and is closed at both ends thereof; a liquid supply path connected to a segment of the shared flow path other than the both ends thereof; a plurality of liquid discharge pores respectively connected to a midway of the shared flow path through a plurality of liquid pressing chambers; and a plurality of pressing parts for respectively pressing liquid in the plurality of liquid pressing chambers. A cross-sectional area of each of segments at the both ends of the shared flow path is smaller than a cross-sectional area of a middle segment thereof.

In the liquid discharge head, when a length of the shared flow path is taken as L (mm), an average cross-sectional area of segments extending from the both ends of the shared flow path to a length L/5 from the both ends is preferably a half or less of an average cross-sectional area of a segment of a length L/2 in a middle of the shared flow path.

In either one of the above liquid discharge heads, the cross sectional area of the shared flow path preferably changes continuously.

A liquid discharge device of the present invention includes either one of the above liquid discharge heads; and a control part for controlling driving of the plurality of pressing parts. The control part controls to drive the pressing parts at a driving cycle of 0.53 times or less a vibration cycle when liquid in the shared flow path is subjected to a primary resonant vibration.

A recording apparatus of the present invention includes the above liquid discharge device and a transport part for transporting a recording medium to the liquid discharge device.

Effect of the Invention

According to the liquid discharge heads of the present invention, they include the shared flow path being long in one direction; the plurality of liquid discharge pores respectively connected to the midway of the shared flow path through the plurality of liquid pressing chambers; the liquid supply path which is connected to both ends of the shared flow path, and has the larger cross-sectional area than the shared flow path; and the plurality of pressing parts for respectively pressing the liquid in the plurality of liquid pressing chambers. The cross-sectional area of the middle segment of the shared flow path is smaller than the cross-sectional area of each of the both end segments thereof. This increases the frequency of a standing wave occurred in the liquid in the shared flow path. Therefore, no standing wave is excited, or even if excited, its amplification can be reduced.

According to the liquid discharge device of the present invention, the driving frequency is sufficiently lower than the vibration cycle of the primary resonant vibration which is the standing wave having the lowest frequency in situations where the both ends of the shared flow path correspond to the nodes, respectively, and is most likely to occur. Therefore, no standing wave is excited, or even if excited, its amplification can be reduced.

According to the recording apparatus of the present invention, the influence of the standing wave excited in the shared flow path can be mitigated, thereby enhancing recording accuracy.

BRIEF DESCRIPTION OF THE DRAWINGS

FIGS. 7(*b*) and 7(*c*) are schematic diagrams showing standing waves occurred in the shared flow path shown in FIG. 7(*a*);

FIGS. 12(*b*) and 12(*c*) are schematic diagrams showing standing waves occurred in the shared flow path shown in FIG. 12(*a*);

FIGS. 18(*b*) and 18(*c*) are schematic diagrams showing standing waves occurred in the shared flow path shown in FIG. 18(*a*);

PREFERRED EMBODIMENTS FOR CARRYING OUT THE INVENTION

Figure 1:
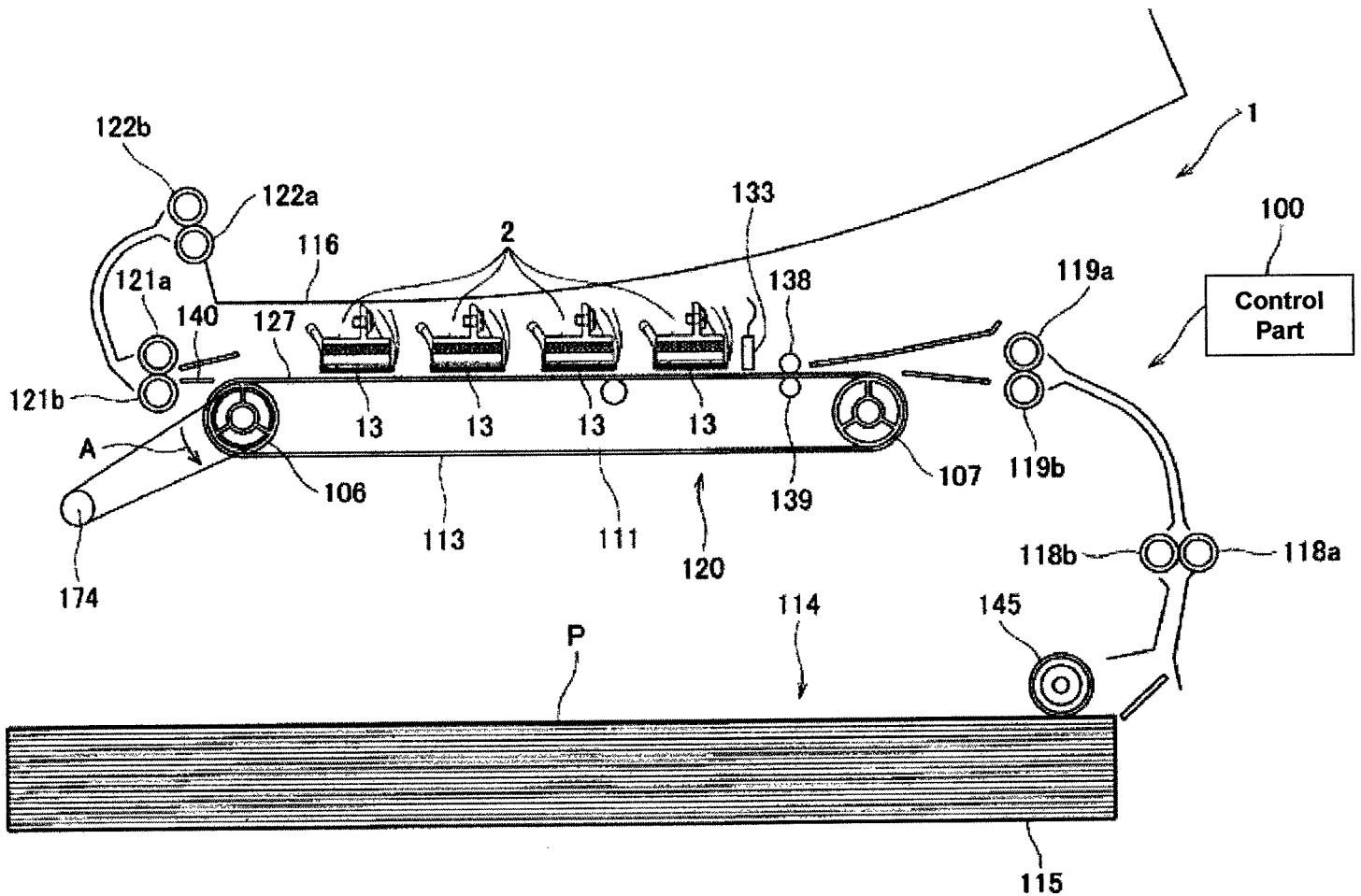
FIG. 1 is a schematic block diagram of a printer that is a recording apparatus according to an embodiment of the present invention.

FIG. 1 is the schematic block diagram of the color inkjet printer that is the recording apparatus including the liquid discharge head according to one embodiment of the present invention. The color inkjet printer 1 (hereinafter referred to as the printer 1) includes four liquid discharge heads 2. These liquid discharge heads 2 are arranged along a transport direction of a printing paper P, and are fixed to the printer 1. The liquid discharge heads 2 have a shape being long and narrow in a direction in which they extend from the near side to the far side in FIG. 1.

The printer 1 is provided with a paper feed unit 114, a transport unit 120, and a paper receiving part 116, which are sequentially installed along a transport path of the printing paper P. The printer 1 is also provided with a control part 100 for controlling operations in the parts of the printer 1, such as the liquid discharge heads 2 and the paper feed unit 114.

The paper feed unit 114 includes a paper storage case 115 for storing a plurality of printing papers P, and a paper feed roller 145. The paper feed roller 145 feeds one by one the uppermost printing paper P in the printing papers P stackedly stored in the paper storage case 115.

Two pairs of feed rollers 118*a* and 118*b*, and 119*a* and 119*b* are disposed between the paper feed unit 114 and the transport unit 120 along the transport path of the printing paper P. The printing paper P fed from the paper feed unit 114 is guided by these feed rollers, and is further fed to the transport unit 120.

The transport unit 120 includes an endless transport belt 111 and two belt rollers 106 and 107. The transport belt 111 is entrained around these belt rollers 106 and 107. The transport belt 111 is adjusted to such a certain length as to be subjected to a predetermined tension force when entrained around these two belt rollers. This allows the transport belt 111 to be entrained without becoming loose, along two planes which are parallel to each other, and respectively include a common tangent of these two belt rollers. One of these two planes which is closer to the liquid discharge heads 2 corresponds to a transport surface 127 for transporting the printing papers P.

A transport motor 174 is connected to the belt roller 106, as shown in FIG. 1. The transport motor 174 rotates the belt roller 106 in the direction of arrow A. The belt roller 107 is rotatable in conjunction with the transport belt 111. Therefore, the transport motor 174 is driven to rotate the belt roller 106, thereby allowing the transport belt 111 to move along the direction of the arrow A.

A nip roller 138 and a nip receiving roller 139 are disposed to hold the transport belt 111 therebetween in the vicinity of the belt roller 107. The nip roller 138 is energized downward by an unshown spring. The nip receiving roller 139 below the nip roller 138 receives the downward energized nip roller 138 through the transport belt 111. These two nip rollers are rotatably installed and are rotated in conjunction with the transport belt 111.

The printing paper P fed from the paper feed unit 114 to the transport unit 120 is held between the nip roller 138 and the transport belt 111. Thereby, the printing paper P is pressed against the transport surface 127 of the transport belt 111, and is fastened onto the transport surface 127. The printing paper P is then transported along with the rotation of the transport belt 111 toward a direction in which the liquid discharge heads 2 are installed. An outer peripheral surface 113 of the transport belt 111 may be subjected to treatment with adhesive silicone rubber. This ensures that the printing paper P is fastened onto the transport surface 127.

These four liquid discharge heads 2 are disposed close to each other along the transport direction by the transport belt 111. Each of these liquid discharge heads 2 has a liquid discharge head body 13 at the lower end thereof. A large number of liquid discharge pores 8 for discharging liquid are disposed in the lower surface of the liquid discharge head body 13 (refer to FIG. 4).

Liquid drops (ink) of identical color are discharged from these liquid discharge pores 8 disposed in the single liquid discharge head 2. These liquid discharge pores 8 of each of these liquid discharge heads 2 are equally spaced in one direction (a direction parallel to the printing paper P and orthogonal to the transport direction of the printing paper P, namely, a longitudinal direction of the liquid discharge head 2). This permits printing in the one direction without leaving no space. The colors of liquids discharged from these liquid discharge heads 2 are respectively magenta (M), yellow (Y), cyan (C), and black (K). Each of these liquid discharge heads 2 is disposed between the lower surface of the liquid discharge head body 13 and the transport surface 127 of the transport belt 111 with a minute gap interposed therebetween.

The printing paper P transported by the transport belt 111 passes through the gap between the liquid discharge head 2 and the transport belt 111. At that time, the liquid drops are discharged from the liquid discharge head body 13 constituting the liquid discharge heads 2 to the upper surface of the printing paper P. Consequently, a color image based on image data recorded by the control part 100 is formed on the upper surface of the printing paper P.

A peeling plate 140 and two pairs of feed rollers 121*a* and 121*b*, and 122*a* and 122*b* are disposed between the transport unit 120 and the paper receiving part 116. The printing paper P with the color image printed thereon is then transported by the transport belt 111 to the peeling plate 140. At this time, the printing paper P is peeled from the transport surface 127 by the right end of the peeling plate 140. The printing paper P is then fed to the paper receiving part 116 by these feed rollers 121*a* to 122*b*. Thus, the printing papers P with the image printed thereon are sequentially fed to the paper receiving part 116 and are stacked one upon another on the paper receiving part 116.

A paper surface sensor 133 is installed between the liquid discharge head 2 located on the most upstream in the transport direction of the printing paper P, and the nip roller 138. The paper surface sensor 133 is comprised of a light emitting element and a light receiving element, and detects a front end position of the printing paper P on the transport path. A detection result obtained by the paper surface sensor 133 is sent to the control part 100. Based on the detection result sent from the paper surface sensor 133, the control part 100 controls the liquid discharge heads 2, the transport motor 174, and the like, so as to establish synchronization between the transportation of the printing paper P and the printing of image.

Figure 2:
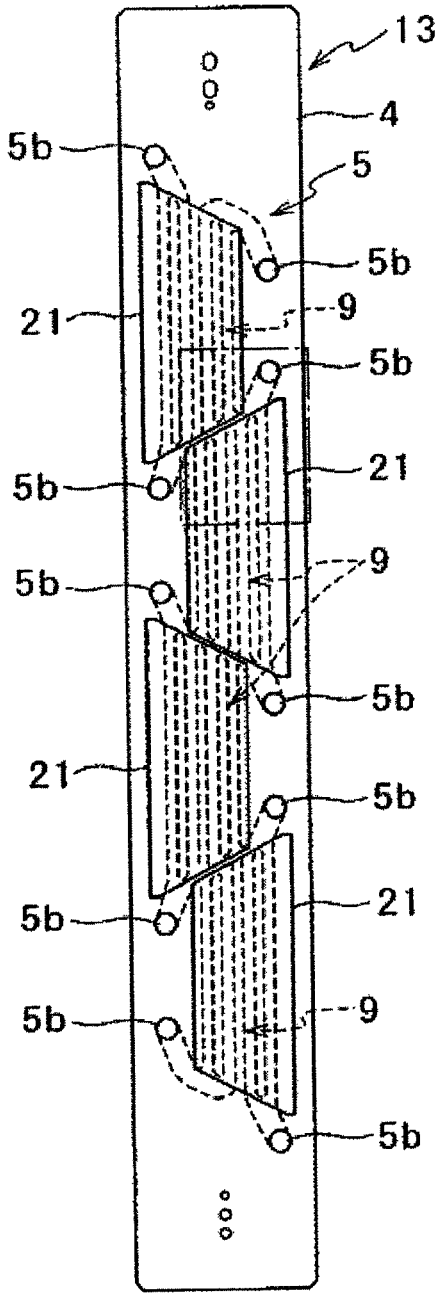
FIG. 2 is a top plan view showing a liquid discharge head body constituting a liquid discharge head in FIG. 1.
Figure 3:
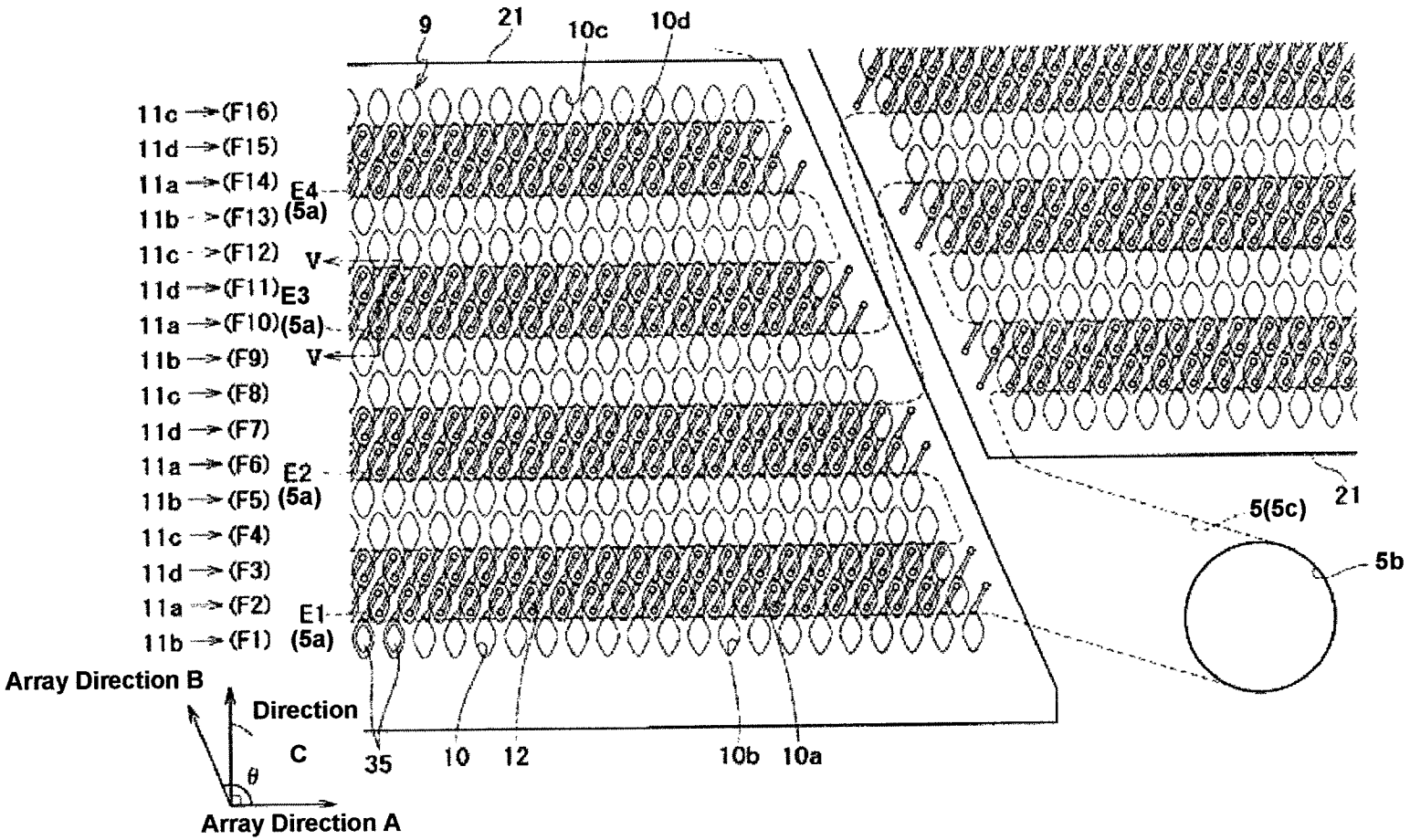
FIG. 3 is one enlarged view of a region surrounded by chain lines in FIG. 2.
Figure 4:
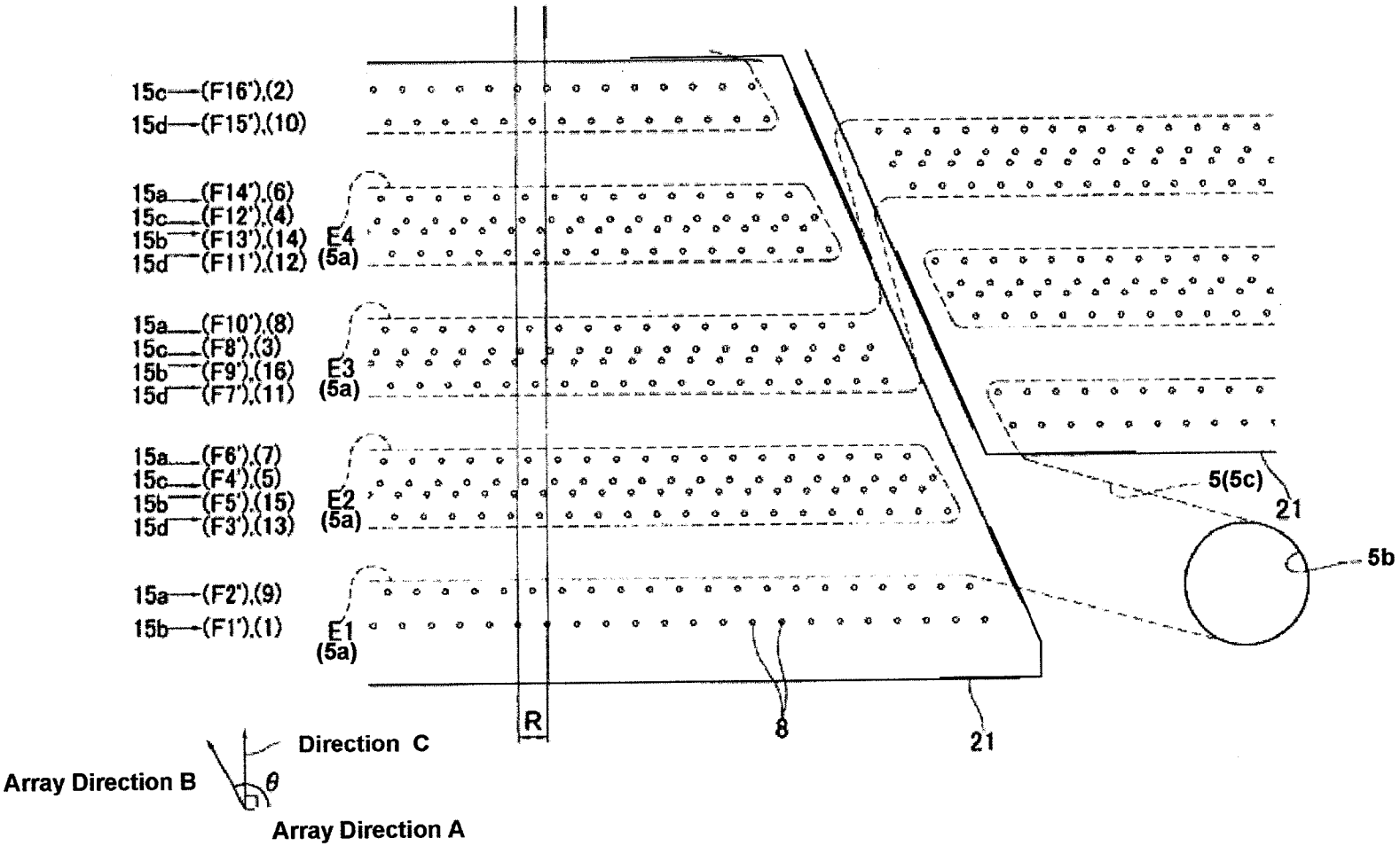
FIG. 4 is another enlarged view of the region surrounded by the chain lines in FIG. 2, from which some paths are omitted for the sake of explanation.
Figure 5:
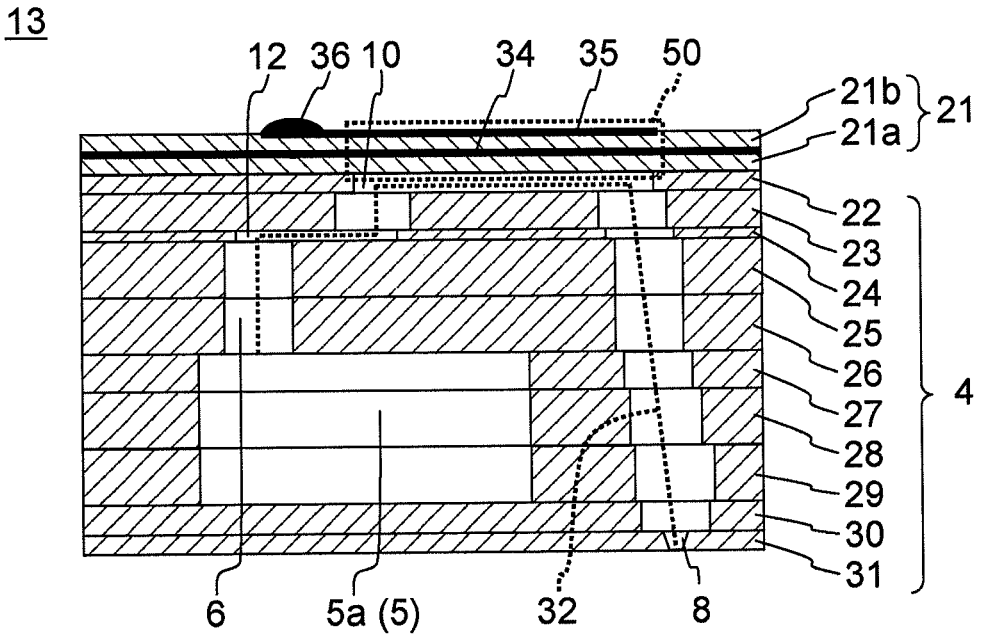
FIG. 5 is a longitudinal cross section taken along the line V-V in FIG. 3.

Next, the liquid discharge head body 13 constituting the liquid discharge head of the present invention is described below. FIG. 2 is the top plan view showing the liquid discharge head body 13 shown in FIG. 1. FIG. 3 is the enlarged top plan view of the region surrounded by the dotted lines in FIG. 2, and shows a part of the liquid discharge head body 13. FIG. 4 is an enlarged perspective view at the same position as FIG. 3, with some paths omitted for the sake of clarifying the positions of the liquid discharge pores 8. In FIGS. 3 and 4, the liquid pressing chambers 10 (liquid pressing chamber groups 9), apertures 12, and the liquid discharge pores 8, which are located below a piezoelectric actuator unit 21 and therefore should be drawn by broken lines, are drawn by solid lines for the sake of clarification. FIG. 5 is the longitudinal cross sectional view taken along the line V-V in FIG. 3.

The liquid discharge head body 13 has a tabular path member 4, and has the piezoelectric actuator unit 21 as an actuator unit on the path member 4. The piezoelectric actuator unit 21 has a trapezoidal shape, and is disposed on the upper surface of the path member 4 so that a pair of parallel opposed sides of the trapezoid are parallel to the longitudinal direction of the path member 4. Two piezoelectric actuator units 21 along each of two virtual straight lines parallel to the longitudinal direction of the path member 4, namely, a total of these four piezoelectric actuator units 21 are staggered on the path member 4 in their entirety. Oblique sides of the piezoelectric actuator units 21 adjacent to each other on the path member 4 are partially overlapped with each other in the transverse direction of the path member 4. The liquid drops discharged from these two piezoelectric actuator units 21 mixingly land on a region to be subjected to printing by driving the piezoelectric actuator units 21 corresponding to the overlapped portion.

Manifolds 5 that are a part of the liquid path are formed inside the path member 4. These manifolds 5 extend along the longitudinal direction of the path member 4, and have a narrow long shape. Openings 5*b* of these manifolds 5 are formed in the upper surface of the path member 4. The five openings 5*b* are formed along each of two straight lines (virtual lines) parallel to the longitudinal direction of the path member 4, namely, a total of the ten openings are formed there. These openings 5*b* are formed at locations except the region in which the four piezoelectric actuator units 21 are disposed. The liquid is supplied from an unshown liquid tank to these manifolds 5 through these openings 5*b*.

The manifolds 5 formed inside the path member 4 are branched into a plurality of pieces (in some cases, the manifolds 5 located at the branched portions are called submanifolds (shared flow paths) 5*a*, and the manifolds 5 extending from the openings 5*b* to the submanifolds 5*a* are called liquid supply paths 5*c*). The liquid supply paths 5*c* connected to the openings 5*b* extend along the oblique sides of the piezoelectric actuator units 21, and are disposed across the longitudinal direction of the path member 4. In the region held between the two piezoelectric actuator units 21, the single manifold 5 is shared by the piezoelectric actuator units 21 adjacent to each other, and the submanifolds 5*a* are branched from both sides of the manifold 5. These submanifolds 5*a* are adjacent to each other in the region opposed to the individual piezoelectric actuator units 21 located inside the path member 4, and extend in the longitudinal direction of the liquid discharge head body 13.

That is, both ends of the submanifold (shared flow path) 5*a* are connected to the liquid supply path 5*c*. The cross-sectional area of a middle segment of the submanifold (shared flow path) 5*a* is larger than the cross-sectional area of each of the both end segments thereof. The cross-sectional areas can be changed by changing the depth of the submanifold (shared flow path) 5*a*. The cross-sectional area of the liquid supply path 5*c* is larger than the cross-sectional area of an end of the submanifold (shared flow path) 5*a*. In FIG. 3, the end of the submanifold (shared flow path) 5*a* is connected to the two liquid supply paths 5*c*. In this case, the total cross-sectional area of these liquid supply paths 5*c* is larger than the cross-sectional area of the end of the submanifold (shared flow path) 5*a*. This is true for the case where three or more liquid supply paths 5*c* are connected to the end of the submanifold (shared flow path) 5*a*.

The path member 4 includes the four liquid pressing chamber groups 9 in which a plurality of liquid pressing chambers 10 are formed in a matrix form (namely, in two dimension and regularly). Each of these liquid pressing chambers 10 is a hollow region having a substantially rhombus planar shape whose corners are rounded. The liquid pressing chambers 10 are formed to open into the upper surface of the path member 4. These liquid pressing chambers 10 are arranged over substantially the entire surface of a region on the upper surface of the path member 4 which is opposed to the piezoelectric actuator units 21. Therefore, each of the individual liquid pressing chamber groups 9 formed by these liquid pressing chambers 10 occupies a region having substantially the same size and shape as the piezoelectric actuator unit 21. The openings of these liquid pressing chambers 10 are closed by allowing the piezoelectric actuator units 21 to adhere to the upper surface of the path member 4.

In the present embodiment, as shown in FIG. 3, the manifolds 5 are branched into the submanifolds 5*a* of four rows E1 to E4 arranged in parallel to each other in the transverse direction of the path member 4. The liquid pressing chambers 10 connected to these submanifolds 5*a* constitute rows of the liquid pressing chambers 10 equally spaced in the longitudinal direction of the path member 4. These rows are arranged in four rows parallel to each other in the transverse direction. The rows, in which the liquid pressing chambers 10 connected to the submanifolds 5*a* are disposed side by side, are arranged in two rows on both sides of the sub manifolds 5*a*.

On the whole, the liquid pressing chambers 10 connected from the manifolds 5 constitute the rows of the liquid pressing chambers 10 equally spaced in the longitudinal direction of the path member 4, and these rows are arranged in 16 rows in parallel to each other in the transverse direction. The number of the liquid pressing chambers 10 per liquid pressing chamber row corresponds to the external shape of a displacement element 50 that is an actuator, and it is arranged so that the number thereof is gradually decreased from the long side to the short side. The liquid discharge pores 8 are also arranged similarly. This permits image formation at a resolution of 600 dpi in the longitudinal direction on the whole. That is, the individual paths 32 are connected to each of the submanifolds 5*a* at spaced intervals corresponding to 150 dpi on average. Specifically, when the liquid discharge pores 8 corresponding to 600 dpi are designed to be dividingly connected to four rows of the submanifolds 5*a*, all the individual paths 32 connected to their respective submanifolds 5*a* are not connected to each other at equally spaced intervals. Therefore, the individual electrodes 32 are formed at spaced intervals of an average of 170 μm or less (for 150 dpi, they are formed at spaced intervals of 25.4 mm/150=169 μm) in the extending direction of the submanifolds 5*a*, namely, in the main scanning direction.

Next, liquid discharge elements, whose cross section is shown in FIG. 5, are described below. The structure thereof is common to the following examples. Individual electrodes 35 described later are respectively formed at positions opposed to the liquid pressing chambers 10 on the upper surface of the piezoelectric actuator unit 21. These individual electrodes 35 are somewhat smaller than the liquid pressing chambers 10, and have a shape substantially similar to that of the liquid pressing chambers 10. The individual electrodes 35 are arranged so as to fall into the range opposed to the liquid pressing chambers 10 on the upper surface of the piezoelectric actuator unit 21.

A large number of liquid discharge pores 8 are formed in a liquid discharge surface on the lower surface of the path member 4. These liquid discharge pores 8 are arranged at positions except the region opposed to the submanifolds 5*a* arranged on the lower surface side of the path member 4. These liquid discharge pores 8 are also arranged in regions opposed to the piezoelectric actuator units 21 on the lower surface side of the path member 4. These liquid discharge pores occupy, as a group, a region having substantially the same size and shape as the piezoelectric actuator units 21. The liquid drops can be discharged from the liquid discharge pores 8 by displacing the displacement element 50 of the corresponding piezoelectric actuator unit 21. The arrangement of the liquid discharge pores 8 is described later in detail. The liquid discharge pores 8 in their respective regions are arranged at equally spaced intervals along a plurality of straight lines parallel to the longitudinal direction of the path member 4.

The path member 4 included in the liquid discharge head body 13 has a multilayer structure having a plurality of plates stacked one upon another. These plates are a cavity plate 22, a base plate 23, an aperture plate 24, a supply plate 25, manifold plates 26, 27, 28, and 29, a cover plate 30, and a nozzle plate 31 in descending order from the upper surface of the path member 4. A large number of holes are formed in these plates. These plates are aligned and stacked one upon another so that these holes are communicated with each other to constitute the individual paths 32 and the submanifolds 5*a*. As shown in FIG. 5, in the liquid discharge head body 13, the liquid pressing chamber 10 is disposed on the upper surface of the path member 4, and the submanifolds 5*a* are disposed inside on the lower surface thereof, and the liquid discharge pores 8 are disposed on the lower surface thereof. Thus, the parts constituting the individual path 32 are disposed close to each other at different positions, and the submanifolds 5*a* and the liquid discharge pores 8 are connected to each other through the liquid pressing chambers 10.

The holes formed in these plates are described below. These holes can be classified as follows. Firstly, there are the liquid pressing chambers 10 formed in the cavity plate 22. Secondly, there is a communication hole constituting a path connected from one end of each of the liquid pressing chambers 10 to the submanifold 5*a*. This communication hole is formed in each of the plates in the range from the base plate 23 (specifically, the inlet of the liquid pressing chamber 10) to the supply plate 25 (specifically, the outlet of the submanifold 5*a*). This communication hole includes the apertures 12 formed in the aperture plate 24, and an individual supply path 6 formed in the supply plate.

Thirdly, there is a communication hole constituting a path communicated from the other end of each of the liquid pressing chambers 10 to the liquid discharge pores 8. This communication hole is referred to as a descender (partial path) in the following description. The descender 7 is formed in each of the plates in the range from the base plate 23 (specifically, the outlet of the liquid pressing chamber 10) to the nozzle plate 31 (specifically, the liquid discharge pore 8).

Fourthly, there is a communication hole constituting the submanifold 5*a*. This communication hole is formed in the manifold plates 27 to 29. Depending on the position of the submanifold 5*a*, no hole is formed in the manifold plate 29, thus allowing for a change in the cross-sectional area of the submanifold 5*a*.

These communication holes are connected to each other to form the individual path 32 extending from the inlet of the liquid from the sub manifold 5*a* (the outlet of the submanifold 5*a*) to the liquid discharge pore 8. The liquid supplied to the submanifold 5*a* is discharged from the liquid discharge pore 8 through the following route. Firstly, the liquid proceeds upward from the submanifold 5*a*, and passes through the individual supply path 6 and reaches one end of the aperture 12. The liquid then proceeds horizontally along the extending direction of the aperture 12, and reaches the other end of the aperture 12. Subsequently, the liquid proceeds upward from there and reaches one end of the liquid pressing chamber 10. Further, the liquid proceeds horizontally along the extending direction of the liquid pressing chamber 10, and reaches the other end of the liquid pressing chamber 10. The liquid then mainly proceeds downward while gradually moving from there in a horizontal direction, and proceeds to the liquid discharge pore 8 that opens into the lower surface.

The piezoelectric actuator unit 21 has a multilayer structure made up of two piezoelectric ceramic layers 21*a* and 21*b*, as shown in FIG. 5. Each of these piezoelectric ceramic layers 21*a* and 21*b* has a thickness of approximately 20 μm. The entire thickness of the piezoelectric actuator unit 21 is approximately 40 μm. Both the piezoelectric ceramic layers 21*a* and 21*b* extend to cross over the plurality of liquid pressing chambers 10 (refer to FIG. 3). These piezoelectric ceramic layers 21*a* and 21*b* are composed of ferroelectric lead zirconate titanate (PZT) based ceramic material.

Each of the piezoelectric actuator units 21 includes a common electrode 34 composed of Ag—Pd based metal material or the like, and the individual electrode 35 composed of Au based metal material or the like. As described earlier, the individual electrode 35 is disposed at the position opposed to the liquid pressing chamber 10 on the upper surface of the piezoelectric actuator unit 21. One end of the individual electrode 35 is led out of the region opposed to the liquid pressing chamber 10, and a connection electrode 36 is formed thereon. The connection electrode 36 is composed of, for example, silver-paradigm containing glass frit, and is formed projectly with a thickness of approximately 15 μm. The connection electrode 36 is electrically connected to an electrode installed on an unshown FPC (flexible printed circuit). Although it is described in details later, a driving signal is supplied from the control part 100 to the individual electrode 35 through the FPC. The driving signal is supplied on a fixed cycle in synchronization with a transport speed of the printing medium P.

The common electrode 34 is formed over substantially the entire surface in a planar direction in a region between the piezoelectric ceramic layer 21*a* and the piezoelectric ceramic layer 21*b*. That is, the common electrode 34 extends to cover all the liquid pressing chambers 10 in a region opposed to the piezoelectric actuator units 21. The thickness of the common electrode 34 is approximately 2 μm. The common electrode 34 is grounded and held at ground potential in an unshown region. In the present embodiment, a surface electrode (not shown) different from the individual electrode 35 is formed at a position that is kept away from an electrode group made up of the individual electrodes 35 on the piezoelectric ceramic layer 21*b*. The surface electrode is electrically connected to the common electrode 34 via a through hole formed inside the piezoelectric ceramic layer 21*b*, and is connected to another electrode on the EPC similarly to the large number of individual electrodes 35.

The common electrode 34 and the individual electrode 35 are arranged to hold therebetween only the piezoelectric ceramic layer 21*b* that is the uppermost layer, as shown in FIG. 5. The region held between the individual electrode 35 and the common electrode 34 in the piezoelectric ceramic layer 21*b* is referred to as an active area, and the piezoelectric ceramics of the area is polarized. In the piezoelectric actuator units 21 of the present embodiment, only the uppermost piezoelectric ceramic layer 21*b* includes the active area, whereas the piezoelectric ceramic layer 21*a* does not include the active area, and acts as a diaphragm. This piezoelectric actuator unit 21 has a so-called unimolf type configuration.

As described later, a predetermined driving signal is selectively applied to the individual electrode 35, thereby applying pressure to the liquid in the liquid pressing chamber 10 corresponding to this individual electrode 35. Consequently, the liquid drops are discharged from the corresponding liquid discharge pore 8 through the individual path 32. That is, the part of the piezoelectric actuator unit 21 which is opposed to the liquid pressing chamber 10 corresponds to the individual displacement element 50 (actuator) corresponding to the liquid pressing chamber 10 and the liquid discharge pore 8. Specifically, the displacement element 50, whose unit structure is such a structure as shown in FIG. 5, is fabricated into a multilayer body made up of these two piezoelectric ceramic layers in each of liquid pressing chambers 10 by using the diaphragm 21*a* located immediately above the liquid pressing chamber 10, the common electrode 34, the piezoelectric ceramic layer 21*b*, and the individual electrode 35. The piezoelectric actuator unit 21 includes the plurality of displacement elements 50. In the present embodiment, the amount of the liquid discharged from the liquid discharge pore 8 by a single discharge operation is approximately 5-7 pL (pico litter).

The large number of individual electrodes 35 are individually electrically connected to an actuator control means through a contact and wiring on the FPC so that their respective potentials can be controlled individually.

In the piezoelectric actuator units 21 in the present embodiment, when the individual electrodes 35 are set to a potential different from that of the common electrode 34, and an electric field is applied to the piezoelectric ceramic layer 21*b* in the polarization direction thereof, an area to which the electric field is applied acts as an active area that is distorted due to piezoelectric effect. At this time, the piezoelectric ceramic layer 21*b* expands or contracts in the thickness direction thereof, namely the stacking direction thereof, and tends to contract or expand in a direction orthogonal to the stacking direction, namely, the planar direction by transverse piezoelectric effect. On the other hand, the other piezoelectric ceramic layer 21*a* is a non-active layer that does not have the region held between the individual electrode 35 and the common electrode 34, and therefore does not deform spontaneously. That is, the piezoelectric actuator unit 21 has a so-called unimolf type configuration in which the piezoelectric ceramic layer 21*b* on the upper side (namely, the side away from the liquid pressing chamber 10) is the layer including the active area, and the piezoelectric ceramic layer 21*a* on the lower side (namely, the side close to the liquid pressing chamber 10) is the non-active layer.

When in this configuration, the individual electrode 35 is set to a positive or negative predetermined potential with respect to the common electrode 34 by an actuator control part so that the electric field and the polarization are oriented in the same direction, the area (active area) held between the electrodes of the piezoelectric ceramic layer 21*b* contracts in the planar direction. On the other hand, the piezoelectric ceramic layer 21*a* as the non-active layer is not affected by the electric field, and therefore does not contract spontaneously, but tends to restrict the deformation of the active area. Consequently, a difference of distortion in the planarization direction occurs between the piezoelectric ceramic layer 21*b* and the piezoelectric ceramic layer 21*a*, and the piezoelectric ceramic layer 21*b* is subjected to deformation (unimolf deformation) so that it is projected toward the liquid pressing chamber 10.

According to an actual driving procedure in the present embodiment, the individual electrode 35 is previously set to a higher potential (hereinafter referred to as high potential) than the common electrode 34, and the individual electrode 35 is temporarily set to the same potential (hereinafter referred to as low potential) as the common electrode 34 every time a discharge request is made. Thereafter, it is again set to the high potential at a predetermined timing. This allows the piezoelectric ceramic layers 21*a* and 21*b* to return to their original shape at the timing that the individual electrode 35 is set to the low potential, and the volume of the liquid pressing chamber 10 is increased compared to its initial state (the state in which the potentials of both electrodes are different from each other). At this time, a negative pressure is applied to the inside of the liquid pressing chamber 10, and the liquid is absorbed from the manifold 5 into the liquid pressing chamber 10. Thereafter, at the timing that the individual electrode 35 is again set to the high potential, the piezoelectric ceramic layers 21*a* and 21*b* are deformed to be projected toward the liquid pressing chamber 10. Then, the pressure inside the liquid pressing chamber 10 become a positive pressure due to the reduced volume of the liquid pressing chamber 10, and the pressure applied to the liquid is increased, and then the liquid drops are discharged. That is, a driving signal containing pulses with reference to the high potential is supplied to the individual electrode 35 for the purpose of discharging the liquid drops. An ideal pulse width is AL (acoustic length) that is the length of time during which a pressure wave propagates from the manifold 5 to the liquid discharge pore 8 in the liquid pressing chamber 10. Thereby, when a negative pressure state inside the liquid pressing chamber 10 is reversed to a positive pressure state, both pressures are combined together, thus allowing the liquid drops to be discharged under a stronger pressure.

In a gradation printing, a gradation expression is carried out by the amount (volume) of liquid drops adjusted by the number of liquid drops continuously discharged from the liquid discharge pore 8, namely, the number of discharges of liquid drops. Therefore, a number of discharges of liquid drops corresponding to a designated gradation representation are carried out continuously from the liquid discharge pores 8 corresponding to a designated dot region. When the liquid discharge is carried out continuously, it is generally preferable that the intervals between pulses supplied for discharging liquid drops be set to the AL. Thereby, the cycle of a residual pressure wave of the pressure generated when previously discharged liquid drops are discharged coincides with the cycle of a pressure wave of the pressure generated when liquid drops discharged later are discharged, and the two are superimposed to amplify the pressure for discharging the liquid drops.

The control part 100 is capable of printing images by repetitively sending the driving signal to the respective displacement elements 50 of the liquid discharge head 2. A driving signal for discharging liquid drops and a driving signal for non-discharging liquid drops (including the case of simply sending no signal) are sent to the respective displacement elements 50 on a certain cycle. The cycle is referred to as a driving cycle, and the frequency thereof is referred to as a driving frequency. For example, when the entire surface is printed with the same color, the respective liquid discharge elements 50 are driven per driving cycle. In the actual driving signal, besides a discharge signal with which one liquid drop is discharged by one pull signal as described above, a cancel signal for decreasing the remaining vibrations that remain in the individual paths 32 may be added after the pull signal, or a plurality of pull signals may be included so that a plurality of liquid drops for representing gradation are landed at one location. Needless to say, discharge by push may be carried out. In either case, when the discharge is carried out continuously from the liquid discharge elements 50, the driving signal is added per driving cycle.

When the displacement elements 50 as pressing parts are driven in this printer 1, the liquid drops are discharged from the liquid discharge pores 8, and at that time, the liquid pressure is also transferred from the liquid pressing chambers 10 through the aperture 12 to the submanifolds 5*a* as the shared flow path. That is, pressure is transferred to the shared flow path from the plurality of pressing parts connected thereto per driving cycle. Therefore, a standing wave may occur by the pressure. This is described by referring to a structure in which both ends of the submanifold are opened; a structure in which one end thereof is closed and the other end is opened; and a structure in which both ends thereof are closed.

Figure 6:
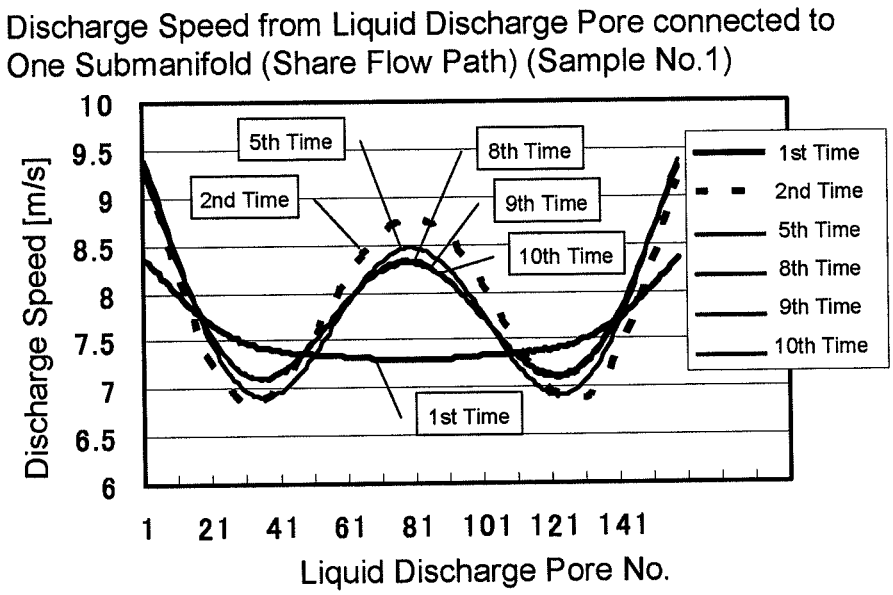
FIG. 6 is graphs showing discharge speed from a nozzle connected to a submanifold in the liquid discharge heads of sample Nos. 1 and 2.
Figure 6:
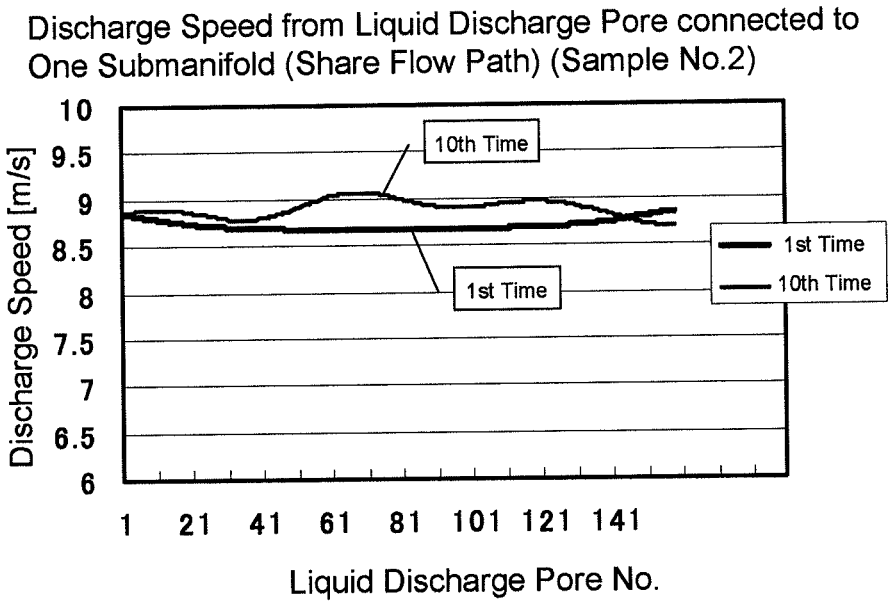
Figure 8:
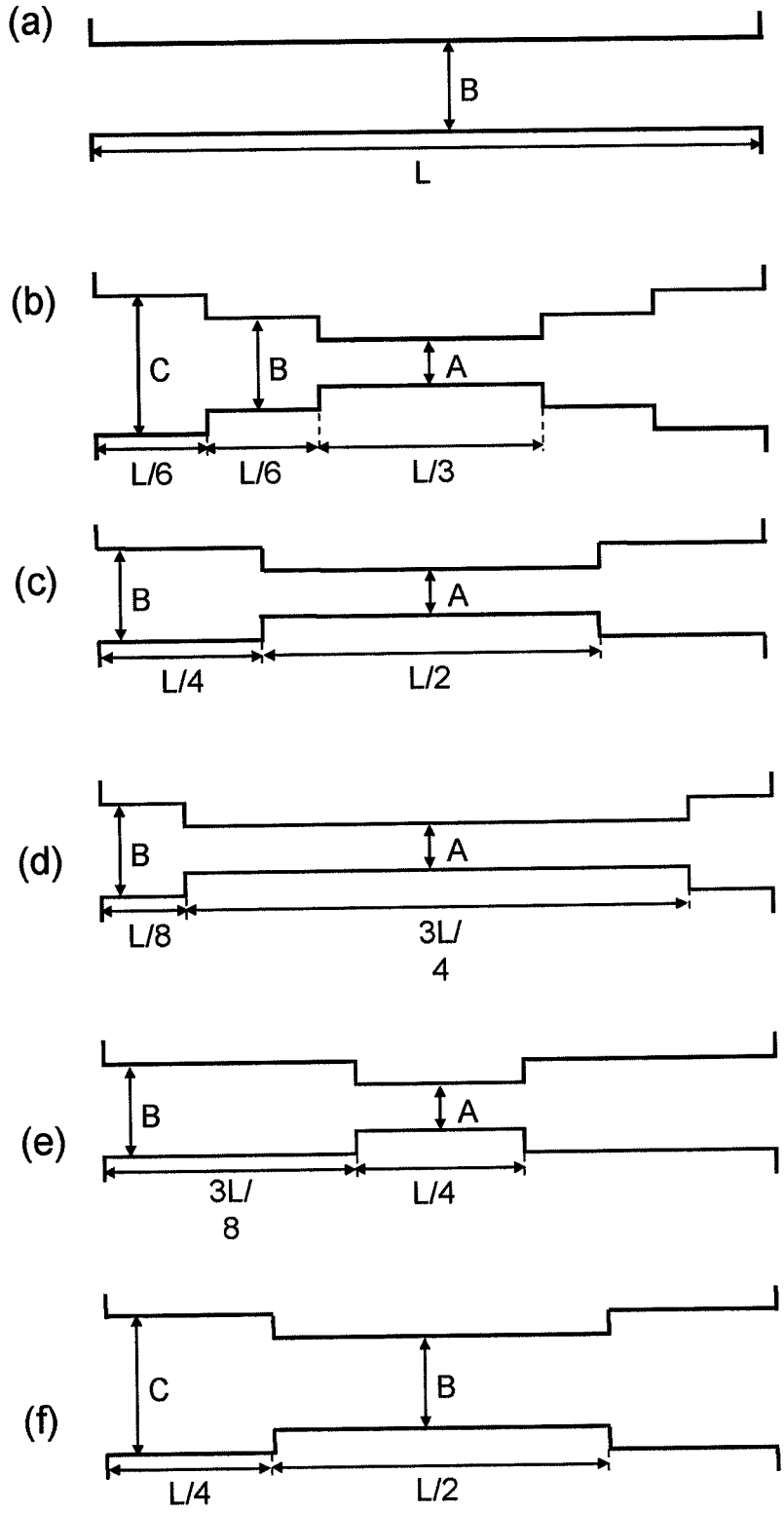
FIGS. 8(*a*) to 8(*f*) are schematic diagrams showing shapes of the shared flow path of the liquid discharge head.

FIG. 6(*a*) is the graph showing measured values of the speed of liquid drops discharged from the liquid discharge pores connected to one shared flow path when the pressing parts are driven by a driving signal of 20 kHz in a liquid discharge head as the shared flow path having the same overall structure as the foregoing liquid discharge head, and having a constant cross-sectional dimension of the shared flow path as shown in FIG. 8(*a*). The discharge of liquid drops corresponds to the discharge from all the liquid discharge pores, namely, the case of printing the entire surface with the same color. The liquid discharge pore numbers are obtained by numbering the liquid discharge pores in order of positions connected to the shared flow path, from one end to the other end of the shared flow path.

Specifically, FIG. 6(*a*) shows the speeds of liquid drops discharged for the first time, the second time, the fifth time, and the 8th to 10th time from a stop status. The discharge speed at which the liquid drops are discharged from each of the liquid discharge pores approaches a certain value as the driving is repeated. Then, the distribution of the discharge speeds becomes periodic related to the position in the shared flow path. This is because the pressure of the standing wave occurred in the shared flow path exerts effects through the apertures. In FIG. 6(*a*), the distributions of the discharge speeds after the second time have a minimum value at two points and a maximum value at one point. However, the liquid discharge speed is not so simple that it increases with increasing pressure exerted by the shared flow path. It can be considered that these distributions are resulted from the occurrence of a standing wave of a primary (basic) resonance described later.

Figure 7:
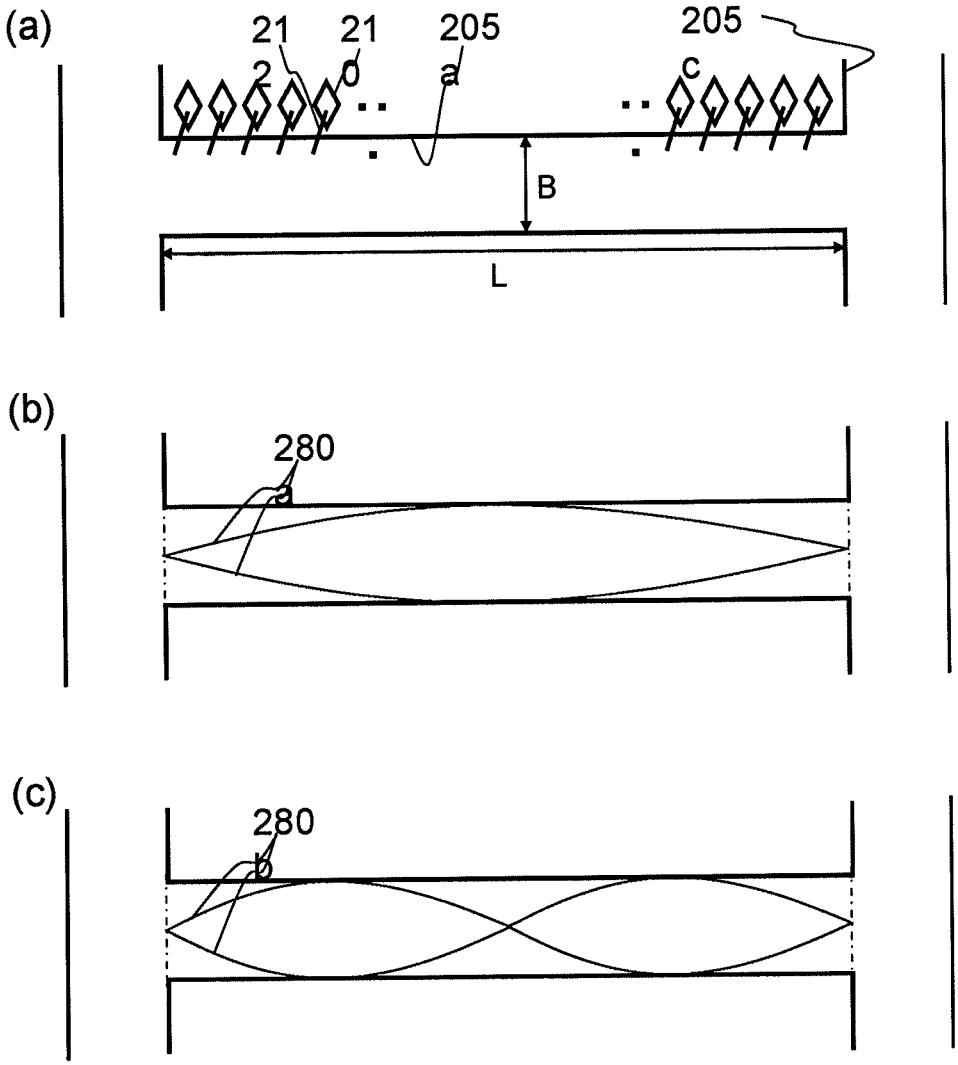
FIG. 7(*a*) is a schematic diagram showing a circumferential form of a shared flow path.

Here, the standing wave occurred in the shared flow path is described. FIG. 7(*a*) is the schematic diagram of the shared flow path 205*a* and the circumferential structure thereof.

Both ends of the shared flow path 205*a* are connected to the liquid supply path 205*c*. The cross-sectional area of the liquid supply path 205*c* is larger than the cross-sectional area of the shared flow path 205*a*. The liquid supply path 205*c* having the larger cross-sectional area makes it difficult for the pressure of the liquid in the shared flow path 205*a* to be transferred to the liquid supply path 205*c*, so that the vicinity of the boundary of the shared flow path 205*a* and the liquid supply path 205*c* corresponds to a node of the standing wave. When the cross-sectional area of the liquid supply path 205*c* is two or more times that of the shared flow path 205*a*, the pressure of the liquid is more unsusceptible to transfer. In FIG. 7(*a*), the liquid supply path 205*c* connected to one end of the shared flow path 205*a* goes in two directions, and the cross-sectional area of each of these liquid supply paths 205*c* is larger than the cross-sectional area of the shared flow path 205*a*. These two are joined together, and the liquid supply path 205*c* whose cross-sectional area is two or more times that of the shared flow path 205*a* is connected to one end of the shared flow path 205*a*.

In the length of the shared flow path 205*a*, a segment having a larger cross-sectional area than the liquid supply path 205*c* is taken as a boundary. Hereinafter, a description is given by taking the length of the shared flow path 205*a* as L mm (hereinafter, the unit mm is omitted in some cases). The shared flow path 205*a* need not have a linear shape. Alternatively, it may have a curved shape, or include a corner part that is bent on the way. In these cases, the length L of the shared flow path 205*a* is a total length of line segments formed by connecting an area center of the cross section. The cross-sectional area of the shared flow path 205*a* is constant and is B mm2 (hereinafter, the unit mm2 is omitted in some cases).

A plurality of liquid pressing chambers 10 are connected through the apertures 212 to the shared flow path 205*a* in length direction. The apertures 212 may be connected thereto at equally spaced intervals, or spatial intervals of 1.0 mm and 0.2 mm may alternate with each other, without limitation thereto. That is, a certain pattern is repeated in the spatial intervals. An unshown pressing part for changing the volume of each of the liquid pressing chambers 10 is adjacent to the liquid pressing chambers 10, thereby forming a path extending from the liquid pressing chamber 10 to the liquid discharge pore.

Although it is not intended to limit that the apertures 212 are connected over the entirety of the length L of the shared flow path 205*a*, the standing wave suppressing structure of the present invention is more useful when the range of connection of the apertures 212 is half or more of the length L of the shared flow path 205*a*, particularly when the range covers the entirety of the length L.

When the liquid discharge head with the above shared flow path 205*a* is driven, as described above, the pressure generated from the pressing part may be transferred to the shared flow path 205*a*, thereby causing standing waves. FIG. 7(*b*) is the graph in which the pressure variation of a standing wave 280*a* occurred by the primary (basic) resonance in the standing waves is schematically overlapped with the shared flow path 205*a*. In the loop of the standing wave 280*a*, a node of zero pressure variation appears at both ends of the boundary between the shared flow path 205*a* and the liquid supply path 205*c*, and the pressure variation increases toward a midportion of the shared flow path 205*a*, and then becomes maximum at the midportion.

FIG. 7(*c*) is the graph in which the pressure variation of a standing wave 280*b* occurred by the secondary resonance in the standing waves is schematically overlapped with the shared flow path 205*a*. In the loop of the standing wave 280*b*, a node of zero pressure variation appears at both ends of the boundary between the shared flow path 205*a* and the liquid supply path 205*c*, and at a midportion of the shared flow path, and the pressure variation becomes maximum at the midportion therebetween.

Although the occurrence of the standing waves depends on the driving cycle, the standing wave of the primary resonance in which the energy required for excitation is the lowest is likely to occur. In the presence of a resonance cycle close to the cycle of the driving signal, and a resonance cycle close to an integral multiple of the cycle of the driving signal, these standing waves are likely to occur. When the standing waves occur and the influence thereof is large, there is a risk of causing a periodic variation in the discharge speed as shown in FIG. 6(*a*).

To make it difficult for the standing wave to occur, it is preferable to increase the frequency of the primary standing wave than the driving frequency. By doing so, the primary standing wave that is normally most likely to occur becomes higher than the driving frequency. Consequently, the standing wave is not likely to occur, and the frequency of a high-order standing wave is also higher than the driving frequency, thus making it difficult for the high-order standing wave to occur.

This standing wave is likely to occur when the cross-sectional area of the shared flow path 205*a* is small. Increasing the frequency of the primary standing wave is more useful when the shared flow paths have an average cross-sectional area of 0.5 mm2 or less, particularly 0.3 mm2 or less. The standing wave is more likely to occur at a higher density of the apertures 212 connected to the shared flow path 205*a*. The increasing the frequency of the primary standing wave is more useful when the five or more apertures 212 are connected per millimeter, and is particularly useful when the ten or more apertures 212 are connected per millimeter. Further, in the case of using the shared flow paths with a constant cross-sectional area, when the driving frequency becomes a driving frequency that is more than 0.53 times the primary resonant frequency, it is useful to reduce the driving frequency to a driving frequency that is 0.53 times or less the primary resonant frequency by changing the cross-sectional shape.

The resonant frequency of the primary standing wave can be increased by decreasing the cross-sectional area of the shared flow path corresponding to the loop of the primary standing wave, or by increasing the cross-sectional area of the shared flow path corresponding to the node of the primary standing wave. That is, it is required to decrease the cross-sectional area of a middle segment of the shared flow path than the cross-sectional area of each of the both end segments. More specifically, in order to further increase the resonant frequency of the primary standing wave, an average cross-sectional area of a segment of a length L/2 in a midportion corresponding to the loop of the primary standing wave in the shared flow path is required to be smaller than an average cross-sectional area of a segment of a length L/4 from each of both ends corresponding to the nodes of the primary standing wave in the shared flow path. Higher effect is obtained by a larger ratio of the cross-sectional areas, preferably ¾ or less, particularly a half or less.

Hereat, the average cross-sectional area is an average cross-sectional area of an average cross-sectional area calculation target region. For example, the average cross-sectional area calculation target region is one in which a plurality of tubes having a constant cross-sectional area are connected to each other, a sum is obtained by multiplying the cross-sectional area of these tubes by a ratio of the lengths of these tubes in the average cross-sectional area calculation target region. That is, this calculation is to divide a value obtained by integrating the cross-sectional area of the tubes in the calculation target region into length direction, by the length of the tubes in the calculation target region. The average cross-sectional area is calculated by dividing the volume of the tubes in the calculation target region by the length of the tube in the calculation target region.

A continuous change of the cross-sectional area in the length direction is preferred to a discontinuous change thereof because liquid discharge characteristics variations are less likely to occur in the vicinity of a discontinuous portion.

The foregoing liquid discharge head 2 is manufactured, for example, in the following manner.

With a general tape forming method, such as roll coater method or slit coater method, a tape composed of piezoelectric ceramic powder and an organic composition is formed and fired, thereby manufacturing a plurality of green sheets serving as piezoelectric ceramic layers 21*a* and 21*b*. An electrode paste serving as the common electrode 34 is formed on a part of each of these green sheets by printing method or the like. Via holes are formed in a part of these green sheets, and via conductors are inserted into these via-holes as needed.

Then, these green sheets are stacked one upon another to manufacture a multilayer body, followed by pressure contact. The multilayer body subjected to the pressure contact is fired in a high oxygen concentration atmosphere, and the individual electrode 35 is printed on the surface of the fired body by using an organic metal paste, followed by firing. Thereafter, the connection electrode 36 is printed by using Ag paste, followed by firing. Thus, the piezoelectric actuator unit 21 is manufactured.

Subsequently, the path member 4 is manufactured by stacking plates 22 to 31 obtained by rolling method or the like. In these plates 22 to 31, holes serving as the manifolds 5, the individual supply paths 6, the liquid pressing chambers 10, and the descenders are processed into their respective predetermined shapes by etching.

These plates 22-31 are preferably formed by at least one kind of metal selected from the group consisting of Fe—Cr base, Fe—Ni base, and WC—TiC base metals. Particularly when ink is used as liquid, these plates are preferably composed of a material having excellent corrosion resistance to the ink. Hence, the Fe—Cr base metals are more preferred.

The piezoelectric actuator unit 21 and the path member 4 can be stacked and bonded together through, for example, an adhesive layer. As the adhesive layer, a well-known one may be used. However, in order to avoid the influence on the piezoelectric actuator unit 21 and the path member 4, it is preferable to use thermosetting resin adhesive of at least one kind selected from the group consisting of epoxy resin, phenol resin, and polyphenylene ether resin, each having a heat-cure temperature of 100-150° C. The piezoelectric actuator unit 21 and the path member 4 can be heat-connected to each other by heating both with the adhesive layer up to the heat-cure temperature, thereby obtaining the liquid discharge head 2.

Thereafter, the electrode at one end, such as the FPC, is connected to the connection electrode 36 of the piezoelectric actuator 21, and the other end of the FPC is connected to the control circuit 100, thereby obtaining the liquid discharge device.

Figure 10:
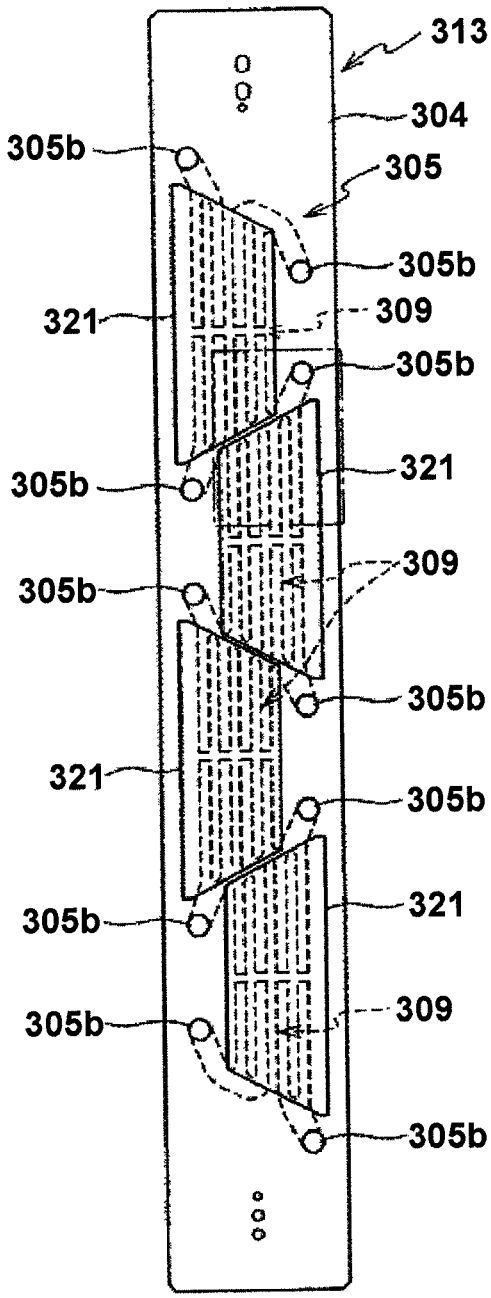
FIG. 10 is a top plan view showing a liquid discharge head body according to an embodiment of the present invention.

Next, a description is given of the case where one end of the submanifold is closed and the other end is opened. In a liquid discharge head body 313 shown in FIG. 10, its basic structure is similar to that of the liquid discharge head 13 shown in FIG. 2, but a manifold 309 is closed in the vicinity of the midportion of the piezoelectric actuator unit 321. That is, one end of the submanifold (shared flow path) 305*a* is closed, and the other end thereof is connected to a liquid supply path 305*c*. The cross-sectional area of the submanifold (shared flow path) 305*a* close to the closed one end thereof is smaller than the cross-sectional area close to the other end thereof connected to the liquid supply path 305*c*. The cross-sectional area thereof can be changed by changing the depth of the submanifold (shared flow path) 305*c*. The cross-sectional area of the liquid supply path 305*c* is larger than the cross-sectional area of the end of the submanifold (shared flow path) 305*a*. In FIG. 10, the end of the submanifold (shared flow path) 305*a* is connected to two liquid supply paths 305*c*. In this case, a total cross-sectional area of these liquid supply paths 305*c* is larger than the cross-sectional area of the end of the submanifold (shared flow path) 305*a*. This is true for the case where three or more liquid supply paths 305*c* are connected to the end of the submanifold (shared flow path) 305*a*.

Figure 11:
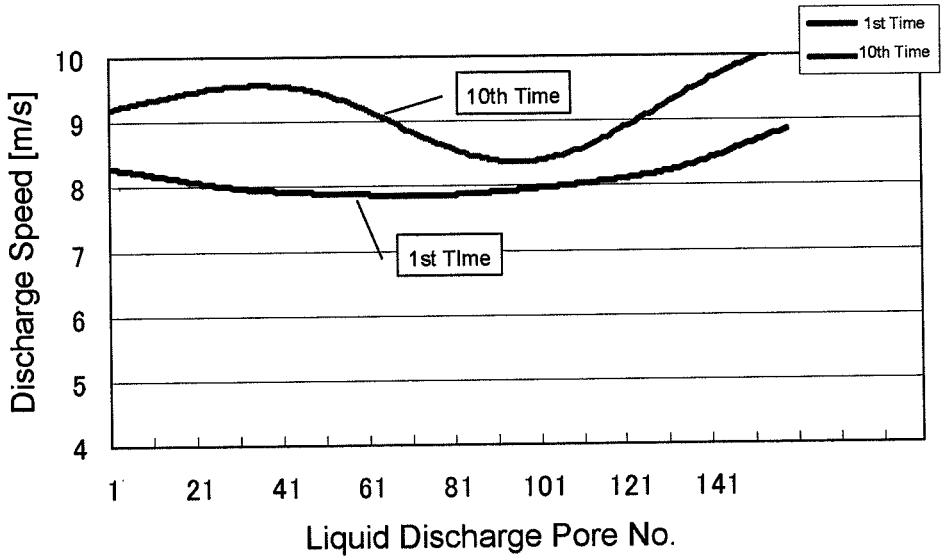
FIG. 11 is graphs showing discharge speed from a nozzle connected to a submanifold in the liquid discharge heads of sample Nos. 101 and 102.
Figure 11:
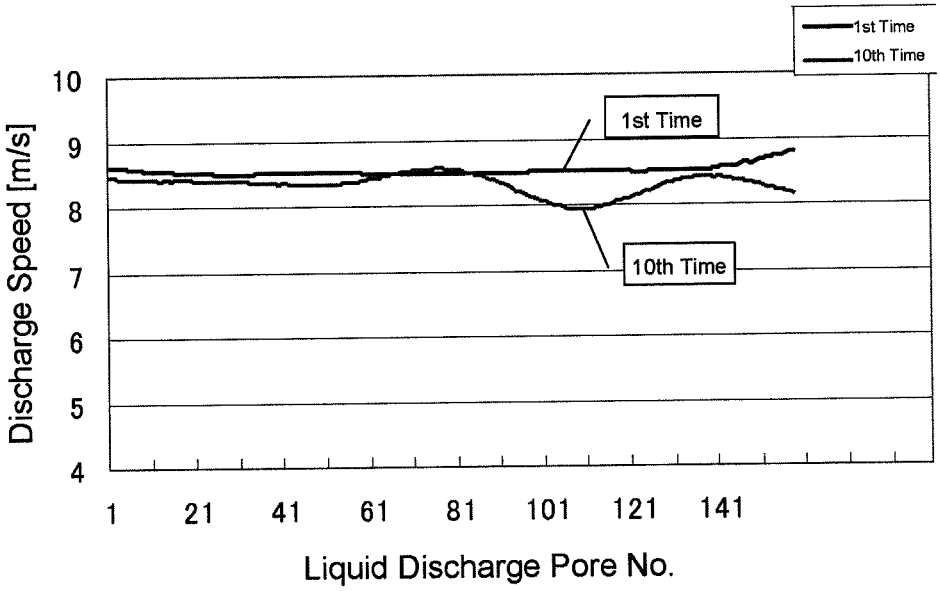

FIG. 11(*a*) shows the speeds of liquid drops discharged for the first time and the 10th time from a stop status. The discharge speed at which the liquid drops are discharged from each of the liquid discharge pores changes as the driving is repeated, and the first discharge and the tenth discharge differ in discharge speed tendency. This is because the pressure of the standing wave occurred in the shared flow path exerts effects through the apertures. After the 10th discharge, substantially the same discharge speed tendency continues, and this distribution becomes a periodic related to the position in the shared flow path. The 10th discharge speed distribution in FIG. 11(*a*) has a minimum value at one point and a maximum value at two points. However, the liquid discharge speed is not so simple that it increases with increasing pressure exerted by the shared flow path. It can be considered that this distribution is resulted from the occurrence of a standing wave of a primary (basic) resonance described later.

Figure 12:
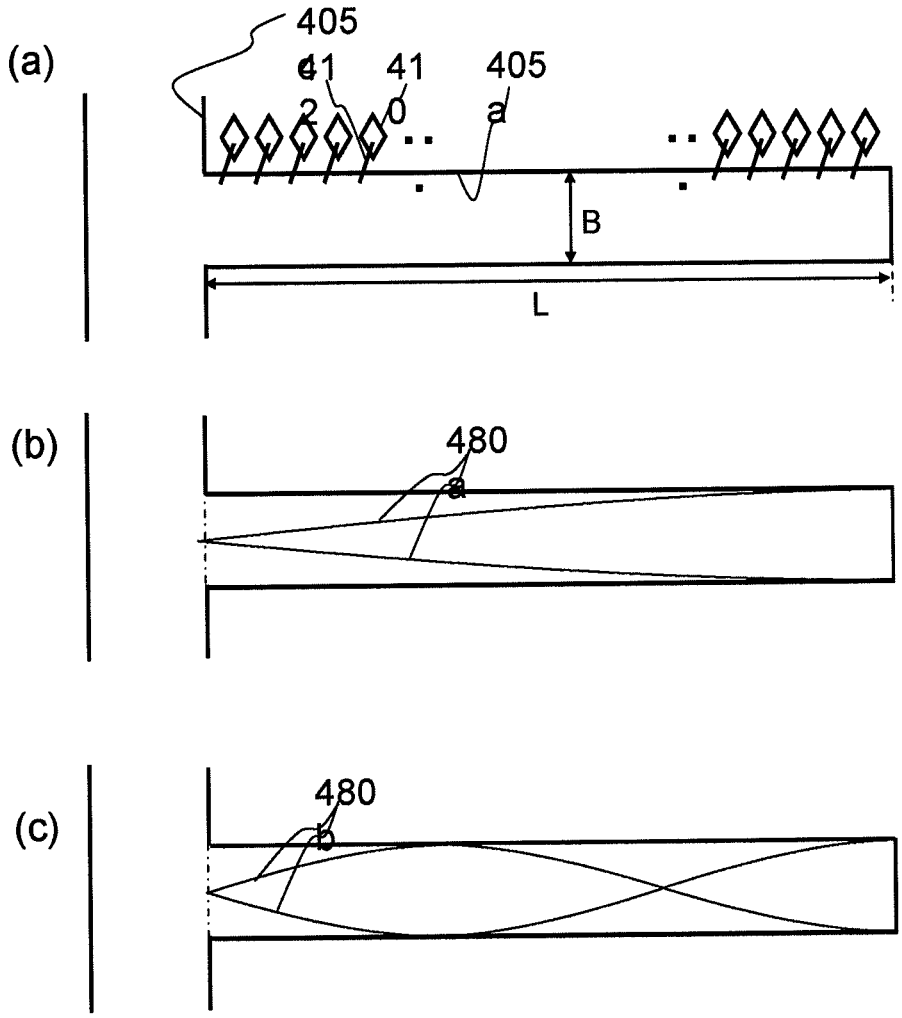
FIG. 12(*a*) is a schematic diagram showing a circumferential form of a shared flow path.

Here, the standing wave occurred in the shared flow path is described. FIG. 12(*a*) is the schematic diagram of the shared flow path 405*a* and the circumferential structure thereof.

One end of a shared flow path 405*a* is closed and the other end thereof is connected to a liquid supply path 405*c*. The cross-sectional area of the liquid supply path 405*c* is larger than the cross-sectional area of the shared flow path 405*a*. The liquid supply path 405*c* having the larger cross-sectional area makes it difficult for the pressure of the liquid in the shared flow path 405*a* to be transferred to the liquid supply path 405*c*, so that the vicinity of the boundary between the shared flow path 405*a* and the liquid supply path 405*c* corresponds to a node of the standing wave. When the cross-sectional area of the liquid supply path 405*c* is two or more times that of the shared flow path 405*a*, the pressure of the liquid is more unsusceptible to transfer. In FIG. 12(*a*), the liquid supply path 405*c* connected to one end of the shared flow path 405*a* goes in two directions, and the cross-sectional area of each of these liquid supply paths 405*c* is larger than the cross-sectional area of the shared flow path 405*a*. These two are joined together, and the liquid supply path 405*c*, whose cross-sectional area is two or more times that of the shared flow path 405*a*, is connected to one end of the shared flow path 405*a*.

In the length of the shared flow path 405*a*, a segment having a larger cross-sectional area than the liquid supply path 405*c* is taken as a boundary. Hereinafter, a description is given by taking the length of the shared flow path 405*a* as L mm (hereinafter, the unit mm is omitted in some cases). The shared flow path 405*a* need not have a linear shape. Alternatively, it may have a curved shape, or include a corner part that is bent on the way. In these cases, the length L of the shared flow path 405*a* is a total length of line segments formed by connecting an area center of the cross section. The cross-sectional area of the shared flow path 405*a* is constant and is B mm2 (hereinafter, the unit mm2 is omitted in some cases).

A plurality of liquid pressing chambers 410 are connected through the apertures 412 to the shared flow path 405*a* in length direction. Apertures 412 may be connected thereto at equally spaced intervals, or spatial intervals of 1.0 mm and 0.2 mm may alternate with each other, without limitation thereto. That is, a certain pattern is repeated in the spatial intervals. An unshown pressing part for changing the volume of each of the liquid pressing chambers 10 is adjacent to the liquid pressing chambers 10, thereby forming a path extending from the liquid pressing chamber 10 to the liquid discharge pore.

Although it is not intended to limit that the apertures 412 are connected over the entirety of the length L of the shared flow path 405*a*, the standing wave suppressing structure of the present invention is more useful when the range of connection of the apertures 412 is half or more of the length L of the shared flow path 405*a*, particularly when the range covers the entirety of the length L.

When the liquid discharge head with the above shared flow path 405*a* is driven, as described above, the pressure generated from the pressing part may be transferred to the shared flow path 405*a*, thereby causing standing waves. FIG. 12(*b*) is the graph in which the pressure variation of a standing wave 480*a* occurred by the primary (basic) resonance in the standing waves is schematically overlapped with the shared flow path 405*a*. In the loop of the standing wave 480*a*, pressure variation becomes maximum at the closed one end of the shared flow path 405*a*, and the pressure variation gradually decreases toward the other end of the shared flow path 405*a*, and a node of zero pressure variation appears at the end of the boundary between the shared flow path 405*a* and the liquid supply path 405*c*.

FIG. 12(*c*) is the graph in which the pressure variation of a standing wave 480*b* occurred by the secondary resonance in the standing waves is schematically overlapped with the shared flow path 405*a*. In the loop of the standing wave 480*b*, pressure variation becomes maximum at the closed one end of the shared flow path 405*a* and at a point of 2L/3 from the closed one end, and a node of zero pressure variation appears at the boundary between the shared flow path 405*a* and the liquid supply path 405*c*, and at a point of L/3 from the closed one end.

Although the occurrence of standing waves depends on the driving cycle, the standing wave of the primary resonance in which the energy required for excitation is the lowest is likely to occur. In the presence of a resonance cycle close to the cycle of the driving signal, and a resonance cycle close to an integral multiple of the cycle of the driving signal, their respective standing waves are likely to occur. When the standing waves occur and the influence thereof is large, there is a risk of causing a periodic variation in the discharge speed as shown in FIG. 11(*a*).

To make it difficult for the standing wave to occur, it is preferable to increase the frequency of the primary standing wave than the driving frequency. By doing so, the primary standing wave that is normally most likely to occur becomes higher than the driving frequency. Consequently, the standing waves are not likely to occur, and the frequency of a high-order standing wave also becomes higher than the driving frequency, thus making it difficult for the high-order standing wave to occur.

The standing waves are likely to occur when the cross-sectional area of the shared flow path 405*a* is small. Increasing the frequency of the primary standing wave is more useful when the shared flow paths have an average cross-sectional area of 0.5 mm2 or less, particularly 0.3 mm2 or less. The standing wave is more likely to occur at a higher density of the apertures 412 connected to the shared flow path 405*a*. The increasing the frequency of the primary standing wave is more useful when the five or more apertures 412 are connected per millimeter, and is particularly useful when the ten or more apertures 412 are connected per millimeter. Further, in the case of using the shared flow paths with a constant cross-sectional area, when the driving frequency becomes a driving frequency that is more than 0.53 times the primary resonant frequency, it is useful to reduce the driving frequency to a driving frequency that is 0.53 times or less the primary resonant frequency by changing the cross-sectional shape.

The resonant frequency of the primary standing wave can be increased by decreasing the cross-sectional area of the shared flow path corresponding to the loop of the primary standing wave, or by increasing the cross-sectional area of the shared flow path corresponding to the node of the primary standing wave. That is, it is required to decrease the cross-sectional area of the closed one end of the shared flow path than the cross-sectional area of the other end thereof. More specifically, in order to further increase the resonant frequency of the primary standing wave, an average cross-sectional area of a segment of a length L/2 from one end corresponding to the loop of the primary standing wave in the shared flow path is required to be smaller than an average cross-sectional area of a segment of a length L/2 from the other end corresponding to the node of the primary standing wave in the shared flow path. Higher effect is obtained by a larger ratio of the cross-sectional areas, preferably ¾ or less, particularly a half or less.

Hereat, the average cross-sectional area is an average cross-sectional area of an average cross-sectional area calculation target region. For example, the average cross-sectional area calculation target region is one in which a plurality of tubes having a constant cross-sectional area are connected to each other, a sum is obtained by multiplying the cross-sectional area of these tubes by a ratio of the length of these tubes in the average cross-sectional area calculation target region. That is, the cross-sectional area of the tube in the calculation target region is multiplied by a ratio of the length of the tubes in the calculation target region into length direction. An average cross-sectional area is calculated by dividing the volume of the tube in the calculation target region by the length of the tube in the calculation target region.

A continuous change of the cross-sectional area in the length direction is preferred to a discontinuous change thereof because liquid discharge characteristics variations are less likely to occur in the vicinity of a discontinuous portion.

Next, a description is given of the case where both ends of the submanifold are closed. The paper surface sensor 133 is installed between the liquid discharge head 2 located at the most upstream in the transport direction of the printing paper P, and the nip roller 138. The paper surface sensor 133 is made up of a light emitting element and a light receiving element, and detects a front end position of the printing paper P on the transport path. A detection result obtained by the paper surface sensor 133 is sent to the control part 100. Based on the detection result sent from the paper surface sensor 133, the control part 100 controls the liquid discharge head 2 and the transport motor 174 or the like so as to establish synchronization between the transport of the printing paper P and the printing of images.

Figure 15:
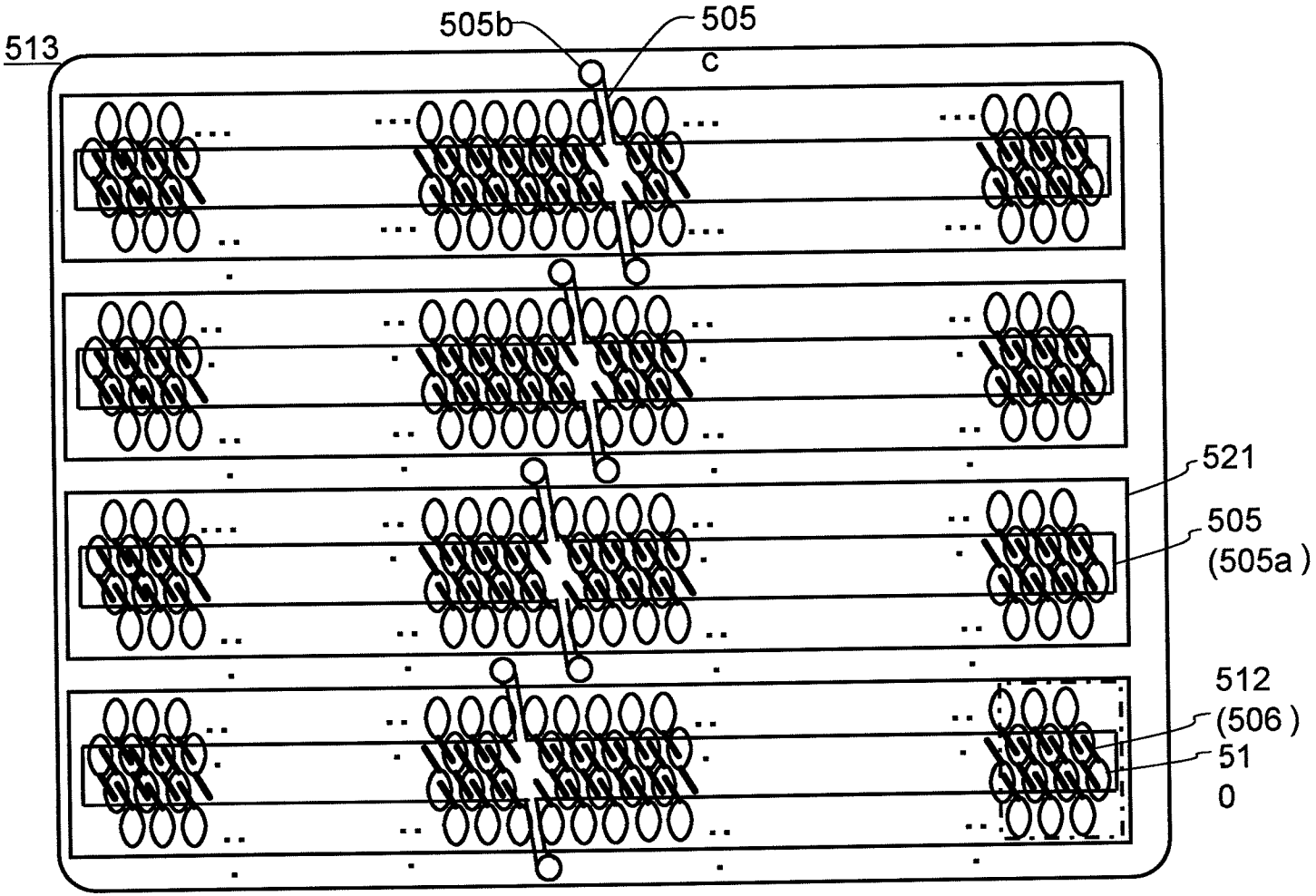
FIG. 15 is a top plan view showing a liquid discharge head body according to other embodiment of the present invention.
Figure 16:
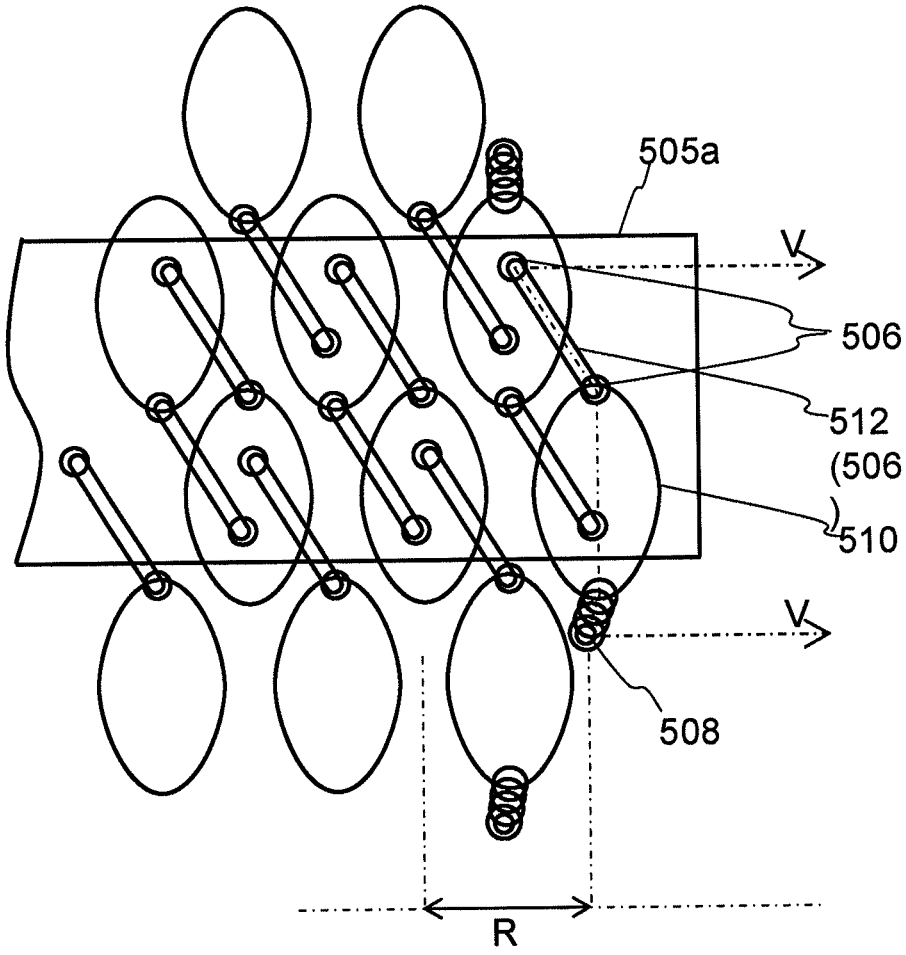
FIG. 16 is an enlarged view of the region surrounded by the chain lines in FIG. 15, from which some paths are omitted for the sake of explanation.

Next, the liquid discharge head body 13 constituting the liquid discharge head of the present invention is described below. FIG. 15 is the top plan view showing the liquid discharge head body 313. FIG. 16 is the enlarged top plan view of the region surrounded by the dotted lines in FIG. 15, and shows a part of the liquid discharge head body 13. In these drawings, some paths are omitted. In FIGS. 15 and 16, manifolds 505, liquid pressing chambers 510, apertures 512, and liquid discharge pores 508, which are located below a piezoelectric actuator unit 521, or are internal structures of a path member 504, and therefore should be drawn by broken lines, are drawn by solid lines for the sake of clarification. The longitudinal cross sectional view in FIG. 15, taken along the line V-V, is the same as that shown in FIG. 5.

A liquid discharge head body 513 has a tabular path member 504, and has a piezoelectric actuator unit 521 as an actuator unit on the path member 504. The piezoelectric actuator unit 521 has a rectangular shape, and is disposed on the upper surface of the path member 504 so that a pair of parallel opposed sides of the rectangular shape are parallel to the longitudinal direction of the path member 504.

A manifold 505 that is a part of the liquid path is formed inside the path member 504. The four manifolds 505 include a submanifold 505*a* extending along the longitudinal direction of the path member 504 and having a narrow long shape, and a liquid supply path 505*c* connecting between the submanifold 505*a* and an opening 505*b* of the manifold 505 located in the upper surface of the path member 504. Liquid is supplied from an unshown liquid tank through the opening 505*b* to the manifold 505.

Both ends of the submanifold (shared flow path) 505*a* are closed, and the liquid supply path 505*c* is connected to a segment of the submanifold (shared flow path) 505*a* other than the both ends thereof. The cross-sectional area of each of the both end segments of the submanifold (shared flow path) 505*a* is smaller than the cross-sectional area of a middle segment thereof. The cross-sectional area can be changed by changing the depth of the submanifold (shared flow path) 505*a*. The cross-sectional area of the liquid supply path 5*c* is smaller than the cross-sectional area of an end of the submanifold (shared flow path) 505*a*.

In the path member 504, a plurality of liquid pressing chambers 510 are formed in a matrix form (namely, in two dimension and regularly). Each of these liquid pressing chambers 510 is a hollow region having a substantially rhombus planar shape whose corners are rounded. The liquid pressing chambers 510 are formed to open into the upper surface of the path member 504. These liquid pressing chambers 510 are arranged over substantially the entire surface of a region on the upper surface of the path member 504 which is opposed to the piezoelectric actuator units 521. Therefore, liquid pressing chamber groups formed by these liquid pressing chambers 510 occupy a region having substantially the same size and shape as the piezoelectric actuator unit 521. The openings of these liquid pressing chambers 510 are closed by allowing the piezoelectric actuator units 21 to adhere to the upper surface of the path member 504.

In the present embodiment, as shown in FIG. 15, the four rows of submanifolds 505*a* are arranged in parallel to each other in the transverse direction of the path member 504. The liquid pressing chambers 510 connected to these submanifolds 505*a* through the apertures 512 constitute rows of the liquid pressing chambers 510 equally spaced in the longitudinal direction of the path member 504. These rows are arranged in four rows parallel to each other in the transverse direction. The rows in which the liquid pressing chambers 510 are connected to the submanifolds 505*a* through the apertures 512 are arranged in two rows on both sides of the sub manifolds 505*a*.

On the whole, the liquid pressing chambers 510 connected to the submanifolds 505*a* constitute the rows of the liquid pressing chambers 510 equally spaced in the longitudinal direction of the path member 504, and these rows are arranged in 16 rows in parallel to each other in the transverse direction. Liquid discharge pores 508 are also arranged similarly to this. This permits image formation at a resolution of 600 dpi in the longitudinal direction on the whole. This means that when projected so as to be orthogonal to a virtual straight line parallel to the longitudinal direction as shown in FIG. 16, four liquid discharge pores 508 connected to the submanifolds 505*a*, namely, a total of 16 liquid discharge pores 8 are disposed at equally spaced intervals of 600 dpi. That is, the liquid pressing chamber 510 are connected to the single submanifold 505*a* through the apertures 512 at spaced intervals of 150 dpi on average. In FIG. 3, the liquid discharge pores 508 in the range not projected to an R range of the virtual straight line, and paths connected from the liquid discharge pores 508 to the liquid pressing chambers are omitted.

Individual electrodes are respectively formed at positions opposed to the liquid pressing chambers 510 on the upper surface of the piezoelectric actuator unit 521. These individual electrodes are somewhat smaller than the liquid pressing chambers 510, and have a shape substantially similar to that of the liquid pressing chamber 510. The individual electrodes are arranged so as to fall into the range opposed to the liquid pressing chambers 510 on the piezoelectric actuator unit 21.

A large number of liquid discharge pores 8 are formed in a liquid discharge surface on the lower surface of the path member 504. These liquid discharge pores 508 are arranged at positions except the region opposed to the submanifolds 505*a* arranged on the lower surface side of the path member 504. These liquid discharge pores 508 are also arranged in regions opposed to the piezoelectric actuator units 521 on the lower surface side of the path member 504. These liquid discharge pores 508 occupy, as a group, a region having substantially the same size and shape as the piezoelectric actuator unit 21. The liquid drops can be discharged from the liquid discharge pores 508 by displacing the displacement element of the corresponding piezoelectric actuator unit 521. The liquid discharge pores 508 in their respective regions are arranged at equally spaced intervals along a plurality of straight lines parallel to the longitudinal direction of the path member 504.

Figure 17:
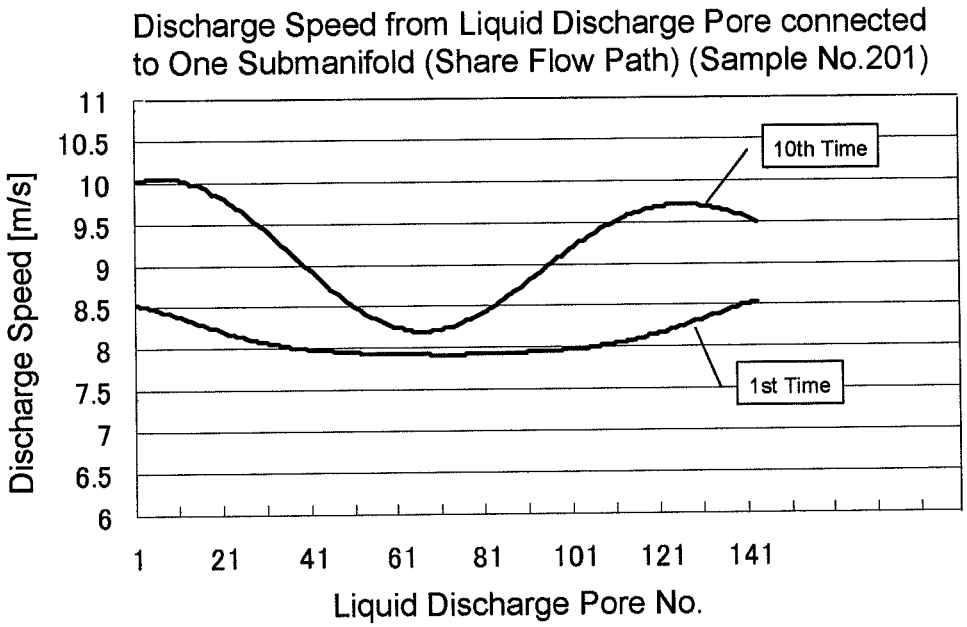
FIGS. 17(*a*) and 17(*b*) are graphs showing discharge speed from a nozzle connected to a submanifold in the liquid discharge heads of sample Nos. 201 and 202.
Figure 17:
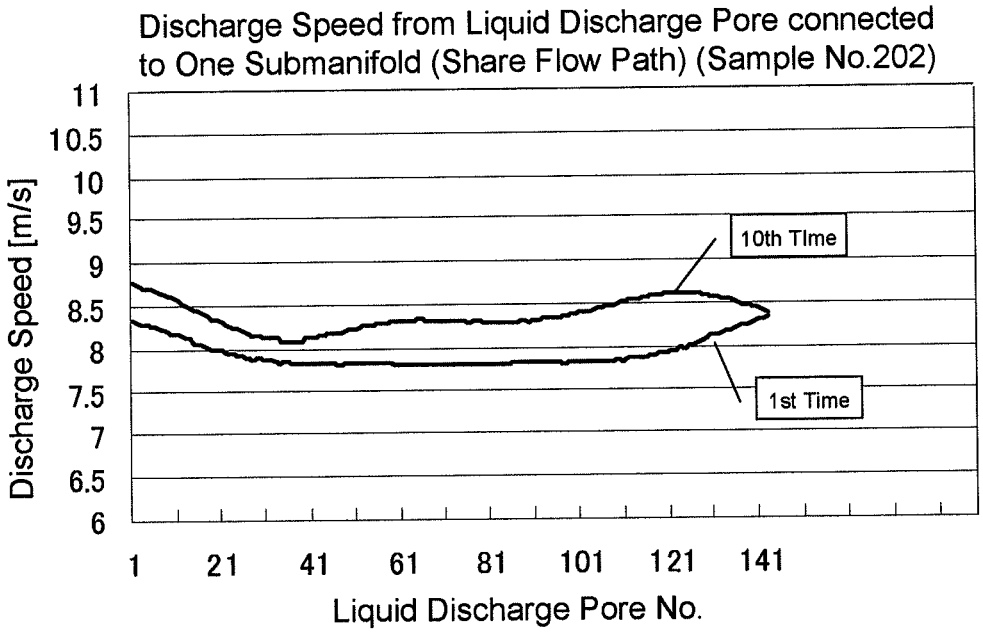

FIG. 17(*a*) shows the speeds of liquid drops discharged for the first time and the 10th time from a stop status. The discharge speed at which the liquid drops are discharged from each of the liquid discharge pores changes as the driving is repeated, and the first discharge and the 10th discharge differ in discharge speed tendency. This is because the pressure of the standing wave occurred in the shared flow path exerts effects through the apertures. After the 10th discharge, substantially the same discharge speed tendency continues, and this distribution becomes a periodic related to the position in the shared flow path. The 10th discharge speed distribution in FIG. 17(*a*) has a minimum value at one point and a maximum value at two points. However, the liquid discharge speed is not so simple that it increases with increasing pressure exerted by the shared flow path. It can be considered that this distribution is resulted from the occurrence of the standing wave of the primary (basic) resonance described later.

Figure 18:
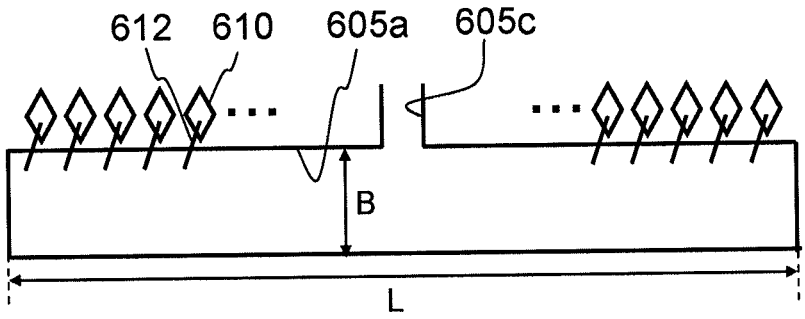
FIG. 18(*a*) is a schematic diagram showing a circumferential form of a shared flow path.
Figure 18:
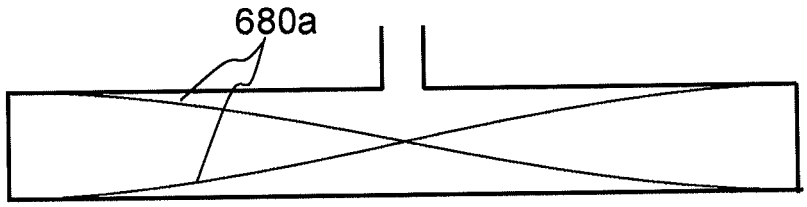
Figure 18:
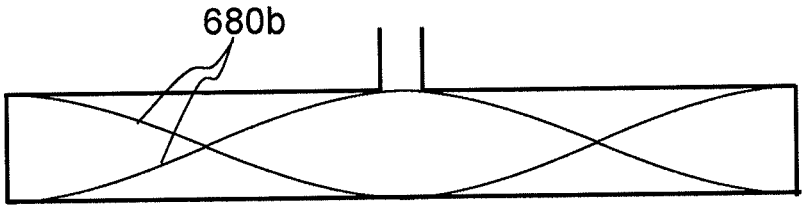

Here, the standing wave occurred in the shared flow path is described. FIG. 18(*a*) is the schematic diagram of a shared flow path 605*a* and the circumferential structure thereof.

Both ends of the shared flow path 605*a* are closed, and the shared flow path is connected at a midportion thereof to a liquid supply path 605*c*. The cross-sectional area of a liquid supply path 605*c* is smaller than the cross-sectional area of the shared flow path 605*a*. The liquid supply path 505*c* having the smaller cross-sectional area makes it difficult for the pressure of the liquid in the shared flow path 605*a* to be transferred to the liquid supply path 605*c*. Thereby, the position, to which the liquid supply path 605*c* is connected, exerts less influence on the standing wave in the shared flow path 605*a*. The both ends of the shared flow path 605*a* are closed, and therefore correspond to the loop of a standing wave at which pressure vibration variation becomes maximum. In order to avoid influence on the state of in which the both ends correspond to the loop, it is preferable not to install the liquid supply path 605*c* at the both ends, and install it in a range of L/2 in a midportion of the shared flow path 605*a*.

Hereinafter, a description is given by taking the length of the shared flow path 605*a* as L mm (hereinafter, the unit mm is omitted in some cases). The shared flow path 605*a* need not have a linear shape. Alternatively, it may have a curved shape, or include a corner part that is bent on the way. In these cases, the length L of the shared flow path 605*a* is the total length of line segments formed by connecting an area center of the cross section. The cross-sectional area of the shared flow path 605*a* is constant and is B mm2 (hereinafter, the unit mm2 is omitted in some cases).

A plurality of liquid pressing chambers 10 are connected through apertures 612 to the shared flow path 605*a* in length direction. The apertures 612 may be connected thereto at equally spaced intervals, or spatial intervals of 1.0 mm and 0.2 mm may alternate with each other, without limitation thereto. That is, a certain pattern is repeated in the spatial intervals. An unshown pressing part for changing the volume of each of the liquid pressing chambers 10 is adjacent to the liquid pressing chambers 10, thereby forming a path extending from the liquid pressing chambers 10 to the liquid discharge pore.

Although it is not intended to limit that the apertures 612 are connected over the entirety of the length L of the shared flow path 605*a*, the standing wave suppressing structure of the present invention is more useful when the range of connection of the apertures 612 is half or more of the length L of the shared flow path 605*a*, particularly when the range covers the entirety of the length L.

When the liquid discharge head with the above shared flow path 605*a* is driven, as described above, the pressure generated from the pressing part may be transferred to the shared flow path 605*a*, thereby causing standing waves. FIG. 18(*b*) is the graph in which the pressure variation of a standing wave 280*a* occurred by the primary (basic) resonance in the standing waves is schematically overlapped with the shared flow path 605*a*. In the loop of the standing wave 280*a*, pressure variation becomes maximum at the closed one end of the shared flow path 605*a*, and the pressure variation gradually decreases toward a midportion of the shared flow path 605*a*, and a node of zero pressure variation appears at the midportion.

FIG. 18(*c*) is the graph in which the pressure variation of a standing wave 280*b* occurred by the secondary resonance in the standing waves is schematically overlapped with the shared flow path 605*a*. In the loop of the standing wave 280*b*, pressure variation becomes maximum at the closed both ends of the shared flow path 605*a* and at the midportion thereof, and a node of zero pressure variation appears at a point of L/4 and a point of 3L/4 from one end of the shared flow path 605*a*.

Although the occurrence of standing waves depends on the driving cycle, the standing wave of the primary resonance in which the energy required for excitation is the lowest is likely to occur. In the presence of a resonance cycle close to the cycle of the driving signal, and a resonance cycle close to an integral multiple of the cycle of the driving signal, these standing waves are likely to occur. When the standing waves occur and the influence thereof is large, there is a risk of causing a periodic variation in the discharge speed as shown in FIG. 17(*a*).

To make it difficult for the standing wave to occur, it is preferable to increase the frequency of the primary standing wave than the driving frequency. By doing so, the primary standing wave, which is normally most likely to occur, becomes higher than the driving frequency. Consequently, this standing wave is not likely to occur, and the frequency of a high-order standing wave also becomes higher than the driving frequency, thus making it difficult for the high-order standing wave to occur. This suppresses the occurrence of the periodic discharge speed variation due to the cycle of the high-order standing wave.

This standing wave is likely to occur when the cross-sectional area of the shared flow path 605*a* is small. Increasing the frequency of the primary standing wave is more useful when the shared flow paths have an average cross-sectional area of 0.5 mm2 or less, particularly 0.3 mm2 or less. The standing wave is also more likely to occur at a higher density of the apertures 612 connected to the shared flow path 605*a*. The increasing the frequency of the primary standing wave is more useful when the five or more apertures 612 are connected per millimeter, and is particularly useful when the ten or more apertures 612 are connected per millimeter. Further, in the case of using the shared flow paths 605*a* with a constant cross-sectional area, if a resonance cycle during vibration at a primary resonant frequency of the liquid in the shared flow path 605*a* becomes a cycle shorter than 1/0.53 times the driving cycle, it is useful to change the cross-sectional shape so that the resonance cycle during the vibration at the primary resonant frequency of the liquid in the shared flow path 605*a* becomes a cycle of 1/0.53 times or more the driving frequency.

The resonant frequency of the primary standing wave can be increased by decreasing the cross-sectional area of the shared flow path 605*a* corresponding to the loop of the primary standing wave, or by increasing the cross-sectional area of the shared flow path 605*a* corresponding to the node of the primary standing wave. That is, it is required to decrease the cross-sectional area at the both closed ends of the shared flow path 605*a* than the cross-sectional area of the middle segment thereof. More specifically, in order to further increase the resonant frequency of the primary standing wave, an average cross-sectional area of a segment from each of the both ends to a segment of a length L/4 from each of the both ends in the shared flow path 605*a* corresponding to the loop of the primary standing wave of the shared flow path 605*a* is required to be smaller than an average cross-sectional area of a region of a length L/2 in the midportion of the shared flow path 605*a*. Higher effect is obtained by a larger ratio of the cross-sectional areas, preferably ¾ or less, particularly a half or less.

Hereat, the average cross-sectional area is an average cross-sectional area of an average cross-sectional area calculation target region. That is, the average cross-sectional area is calculated by dividing a value, which is obtained by integrating the cross-sectional area of the tube of the calculation target region in length direction, by the length of the tube of the calculation target region. In other words, it is a value obtained by dividing the volume of the tube in the calculation target region by the length of the tube in the calculation target region.

A smooth change of the cross-sectional area in the length direction of the shared flow path 605*a* is preferred to the case of including a discontinuous level difference because liquid discharge characteristics variations are less likely to occur in the vicinity of an unsmooth portion. The smoothness means that the cross-sectional area of the shared flow path 605*a* does not change sharply, and typically means that the cross-sectional area does not change by a plane orthogonal to the length direction of the shared flow path 605*a*. Further, among the paths extending from the liquid pressing chamber 610 to the shared flow path 605*a*, the average cross-sectional area change of the shared flow path 605*a* between positions to which the adjacent paths are connected in the length direction of the shared flow path 605*a* is preferably 5% or less in front of and behind a single path.

Thus, the case where the both ends of the shared flow path are opened, and the case where the both ends are closed are summarized as follows. In either case, by making the cross-sectional area at both end segments of the shared flow path and the cross-sectional area at the middle segment thereof have different values, no standing wave is excited in the liquid in the shared flow path, or even if excited, its amplification can be reduced. Therefore, the influence on the liquid discharge element is mitigated, and discharge variations in the liquid discharge elements can be reduced.

EXAMPLES

The liquid discharge heads 2 having different shapes of the shared flow path 205*a* were manufactured, and the relationship between the resonant frequency of the primary standing wave and discharge speed variations was evaluated.

Figure 9:
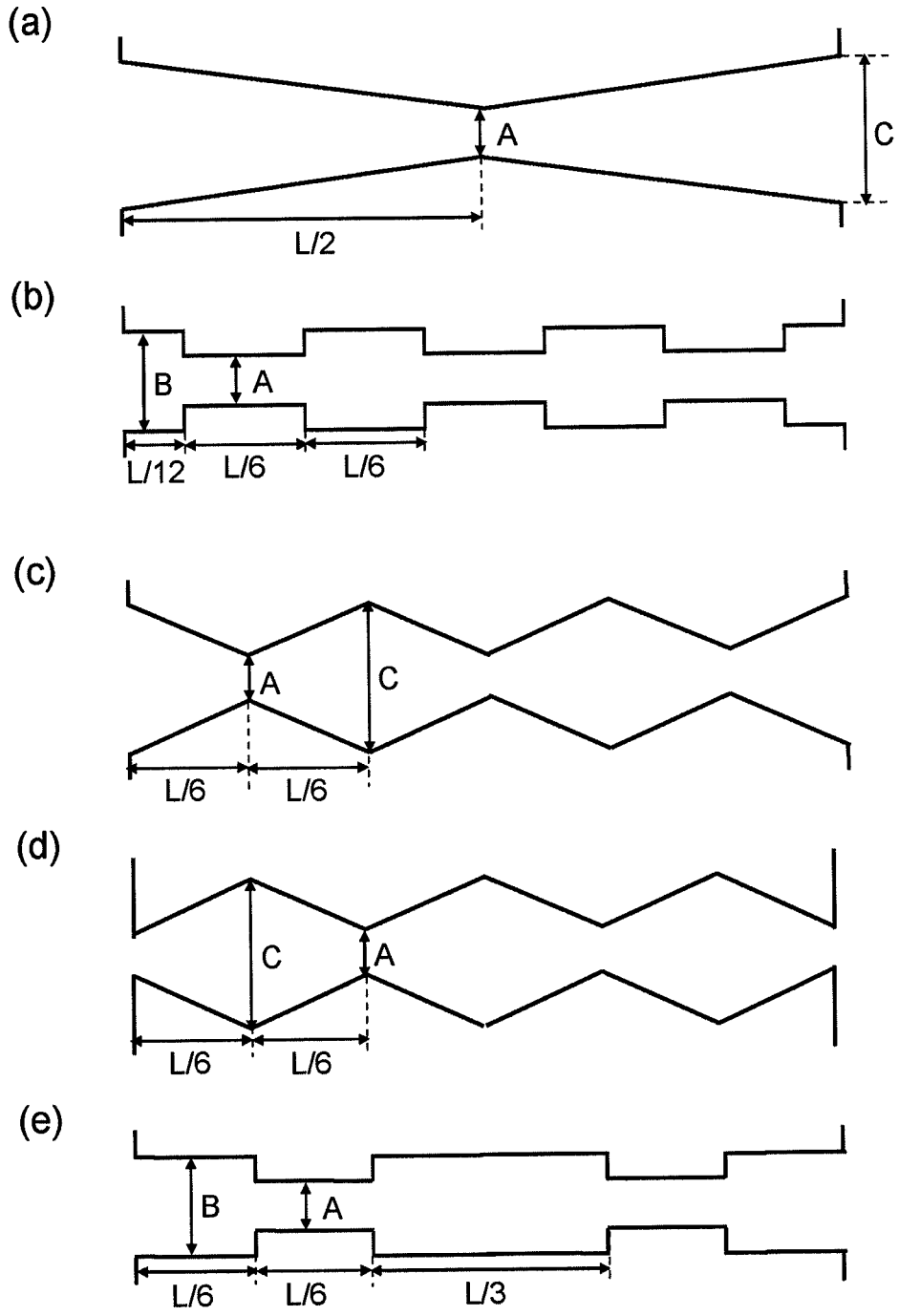
FIGS. 9(*a*) to 9(*e*) are schematic diagrams showing shapes of the shared flow path of the liquid discharge head.

FIGS. 8(*a*) to 8(*f*) and FIGS. 9(*a*) to 9(*e*) are schematic diagrams of the shared flow paths of the tested liquid discharge heads Nos. 1 to 11. Each of these shared flow paths has the same basic structure as the liquid discharge head body 13 shown in FIG. 2.

L was 24 mm, the cross-sectional area A was width 0.6 mm×thickness 0.3 mm, the cross-sectional area B was width 1.3 mm×thickness 0.3 mm, and the cross-sectional area C was width 2.0 mm×thickness 0.3 mm. In the following results, the resonant frequency of the standing wave was calculated by simulation described later. In the liquid discharge speed variations, an actual liquid discharge head was driven at 20 kHz, and the discharge speed of the 10th discharge when performing printing corresponding to solid printing.

The resonant frequency was calculated by setting the density of liquid and the sonic speed in the liquid to 1.04 kg/m3 and 1500 m/sec of the actually used liquid, and by using acoustic analysis software "ANSYS" with finite element method. Specifically, a both-end open-end model was manufactured in the above-mentioned dimension. A frequency analysis was carried out by inputting pressure with the changed frequency from one side. The frequencies at which pressure became maximum were referred to as primary, secondary, and tertiary resonant frequencies in ascending order.

TABLE 1

| | | | | | Discharge Speed | | | |
|---|---|---|---|---|---|---|---|---|
| | Shape of | Resonant Frequency | | | | | | (Max. − Min.)/ |
| No. | Shared Flow Path | Primary | Secondary [kHz] | Tertiary | Average | Max. [m/s] | Min. | Average [%] |
| * 1 | FIG. 8(a) | 31.2 | 62.6 | 93.8 | 7.8 | 9.3 | 7.1 | 28% |
| 2 | FIG. 8(b) | 51.2 | 62.4 | 92.8 | 8.9 | 9.1 | 8.7 | 4% |
| 3 | FIG. 8(c) | 45.2 | 62.4 | 79.2 | 8.9 | 9.2 | 8.6 | 7% |
| 4 | FIG. 8(d) | 38.4 | 75.2 | 105.6 | 8.9 | 9.4 | 8.5 | 10% |
| 5 | FIG. 8(e) | 38.8 | 49.2 | 104.8 | 8.9 | 9.4 | 8.5 | 10% |
| 6 | FIG. 8(f) | 39.2 | 62.4 | 84.8 | 8.9 | 9.4 | 8.5 | 10% |
| 7 | FIG. 9(a) | 46.8 | 62.4 | 102.0 | 8.9 | 9.1 | 8.6 | 6% |
| * 8 | FIG. 9(b) | 22.8 | 42.4 | 133.6 | 8.5 | 10.0 | 7.0 | 35% |
| * 9 | FIG. 9(c) | 24.4 | 45.6 | 139.6 | 8.5 | 9.7 | 7.0 | 32% |

TABLE 1-continued

| No. | Shape of Shared Flow Path | Resonant Frequency Primary | Secondary [kHz] | Tertiary | Discharge Speed Average | Max. [m/s] | Min. | (Max. − Min.)/ Average [%] |
|---|---|---|---|---|---|---|---|---|
| * 10 | FIG. 9(d) | 24.4 | 45.6 | 54.8 | 8.5 | 9.7 | 7.0 | 32% |
| * 11 | FIG. 9(e) | 22.8 | 83.2 | 93.6 | 8.5 | 10.0 | 7.0 | 35% |

Mark * means out of the scope of the invention.

In the liquid discharge head of sample No. 1 with a constant cross-sectional dimension, the primary resonant frequency is 31.2 kHz, which is not so high with respect to the driving frequency 20 kHz. The discharge speed variation is as large as 28%. The discharge speed distribution of this liquid discharge head is that shown in FIG. 6(*a*), and the discharge speed has the periodic distribution as described earlier.

On the contrary, in the liquid discharge head of sample No. 2, the primary resonant frequency is 51.2 kHz, which is high with respect to the driving frequency. The discharge speed variation is extremely reduced to 4%. The discharge speed distribution of this liquid discharge head is shown in FIG. 6(*b*). The periodic distribution of the speed is suppressed even in the 10th discharge.

Thus, in the liquid discharge heads Nos. 2 to 7 of the present invention, the discharge speed variations could be mitigated by increasing the primary resonant frequency. It can be seen that the discharge speed variations are further mitigated as the primary resonant frequency becomes higher. From these results, the discharge speed variations can be reduced to 10% or less by setting the ratio of the driving frequency 20 kHz to the resonant frequency 38.4 kHz, namely, 0.53 times or less.

The shared flow path of the liquid discharge head of sample No. 11 is designed to increase the secondary resonant frequency. The shared flow paths of sample No. 8 and sample No. 8 are designed to increase the tertiary resonant frequency. However, it can be seen that the primary resonant frequency is lowered, and therefore the discharge speed variations become large, thus exerting a large influence of the primary resonant frequency close to the high-order resonant frequency.

Subsequently, the liquid discharge heads in which the shape of the shared flow path 405*a* was modified were manufactured, and the relationship between the resonant frequency of the primary standing wave and discharge speed variations was evaluated.

Figure 13:
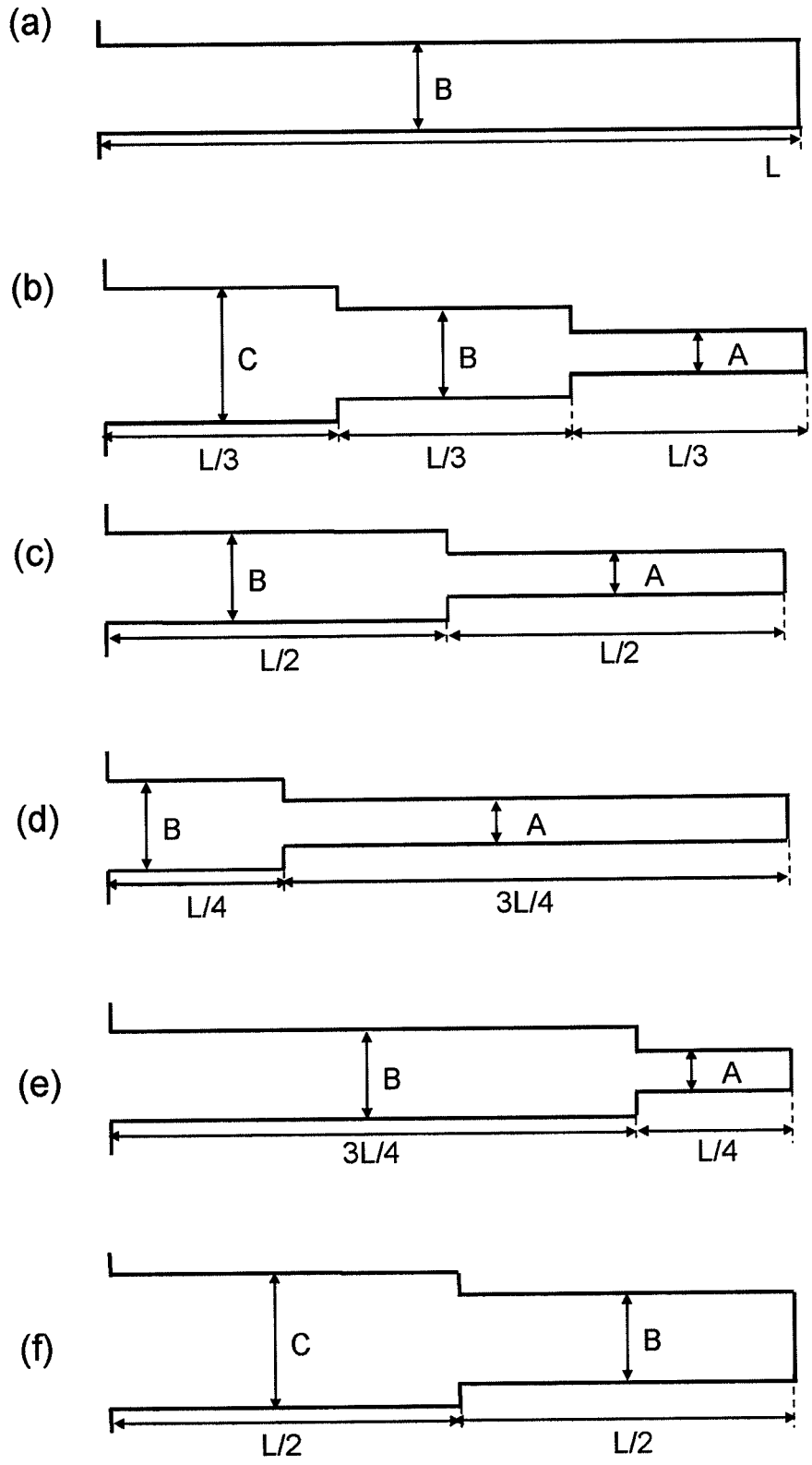
FIGS. 13(*a*) to 13(*f*) are schematic diagrams showing shapes of a shared flow path of the liquid discharge head.
Figure 14:
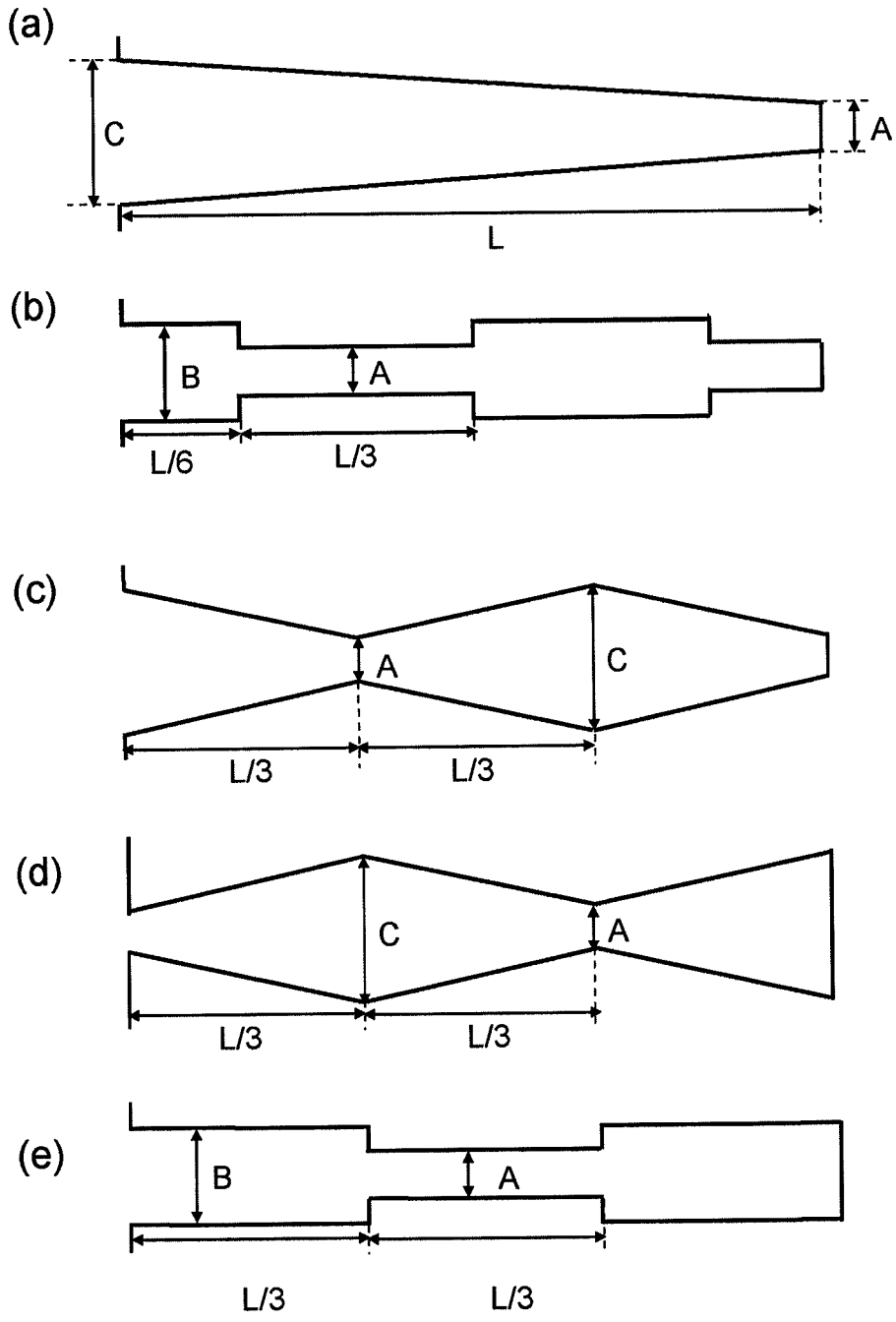
FIGS. 14(*a*) to 14(*e*) are schematic diagrams showing shapes of the shared flow path of the liquid discharge head.

FIGS. 13(*a*) to 13(*f*) and FIGS. 14(*a*) to 14(*e*) are schematic diagrams of the shared flow paths of the tested liquid discharge heads Nos. 101 to 111. Each of these shared flow paths has the same basic structure as the liquid discharge head body 313 shown in FIG. 10.

TABLE 2

| No. | Shape of Shared Flow Path | Resonant Frequency Primary | Secondary [kHz] | Tertiary | Discharge Spaed Average | Max. [m/s] | Min. | (Max. − Min.)/ Average [%] |
|---|---|---|---|---|---|---|---|---|
| * 101 | FIG. 13(a) | 31.2 | 93.6 | 156.0 | 9.2 | 10.1 | 8.4 | 19% |
| 102 | FIG. 13(b) | 51.2 | 92.8 | 135.2 | 8.3 | 8.5 | 8.0 | 6% |
| 103 | FIG. 13(c) | 44.8 | 79.2 | 169.6 | 8.3 | 8.6 | 7.9 | 8% |
| 104 | FIG. 13(d) | 38.4 | 105.6 | 143.6 | 8.8 | 9.2 | 8.4 | 9% |
| 105 | FIG. 13(e) | 38.8 | 104.8 | 142.8 | 8.8 | 9.2 | 8.4 | 9% |
| 106 | FIG. 13(f) | 39.2 | 84.8 | 164.0 | 9.0 | 9.4 | 8.6 | 8% |
| 107 | FIG. 14(a) | 46.8 | 102.0 | 162.0 | 8.6 | 8.8 | 8.3 | 6% |
| * 108 | FIG. 14(b) | 22.8 | 133.6 | 161.6 | 8.6 | 9.9 | 7.3 | 30% |
| * 109 | FIG. 14(c) | 24.4 | 139.6 | 169.6 | 8.6 | 9.8 | 7.4 | 28% |
| * 110 | FIG. 14(d) | 24.4 | 54.8 | 169.6 | 8.6 | 9.8 | 7.4 | 28% |
| * 111 | FIG. 14(e) | 22.8 | 93.6 | 162.0 | 8.6 | 9.9 | 7.3 | 30% |

Mark * means out of the scope of the invention.

In the liquid discharge head of sample No. 101 with a constant cross-sectional dimension, the primary resonant frequency is 31.2 kHz, which is not so high with respect to the driving frequency 20 kHz. The discharge speed variation is as large as 19%. The discharge speed distribution of this liquid discharge head is that shown in FIG. 11(*a*), and the discharge speed has the periodic distribution as described earlier.

On the contrary, in the liquid discharge head of sample No. 102, the primary resonant frequency is 51.2 kHz, which is high with respect to the driving frequency. The discharge speed variation is extremely reduced to 6%. The discharge speed distribution of this liquid discharge head is shown in FIG. 11(*b*). The periodic distribution of the speed is suppressed even in the 10th discharge.

Thus, in the liquid discharge heads Nos. 102 to 107 of the present invention, the discharge speed variations could be mitigated by increasing the primary resonant frequency. It can be seen that the discharge speed variations are further mitigated as the primary resonant frequency becomes higher. From these results, the discharge speed variations can be reduced to 10% or less by setting the ratio of the driving frequency 20 kHz to the resonant frequency 38.4 kHz, namely, 0.53 times or less.

The shared flow paths of sample No. 108 and sample No. 109 are designed to increase the secondary and tertiary resonant frequencies. However, it can be seen that the primary resonant frequency is lowered, and therefore the discharge speed variations become large, thus exerting a large influence of the primary resonant frequency close to the high-order resonant frequency.

Subsequently, the liquid discharge heads in which the shape of the shared flow path 605*a* was modified were manufactured, and the relationship between the resonant frequency of the primary standing wave and discharge speed variations was evaluated.

Figure 19:
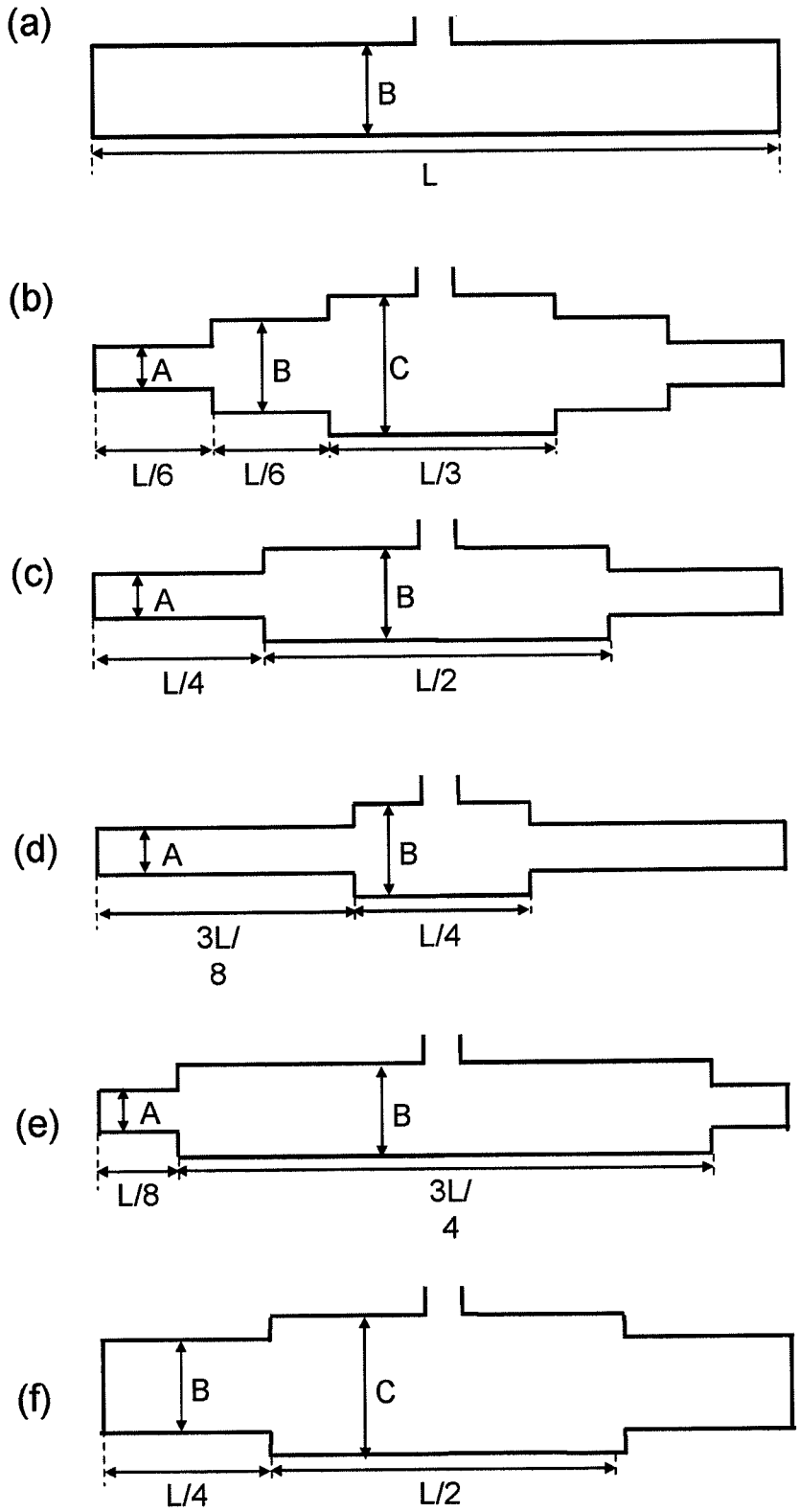
FIGS. 19(*a*) to 19(*f*) are schematic diagrams showing shapes of the shared flow path of the liquid discharge head.
Figure 20:
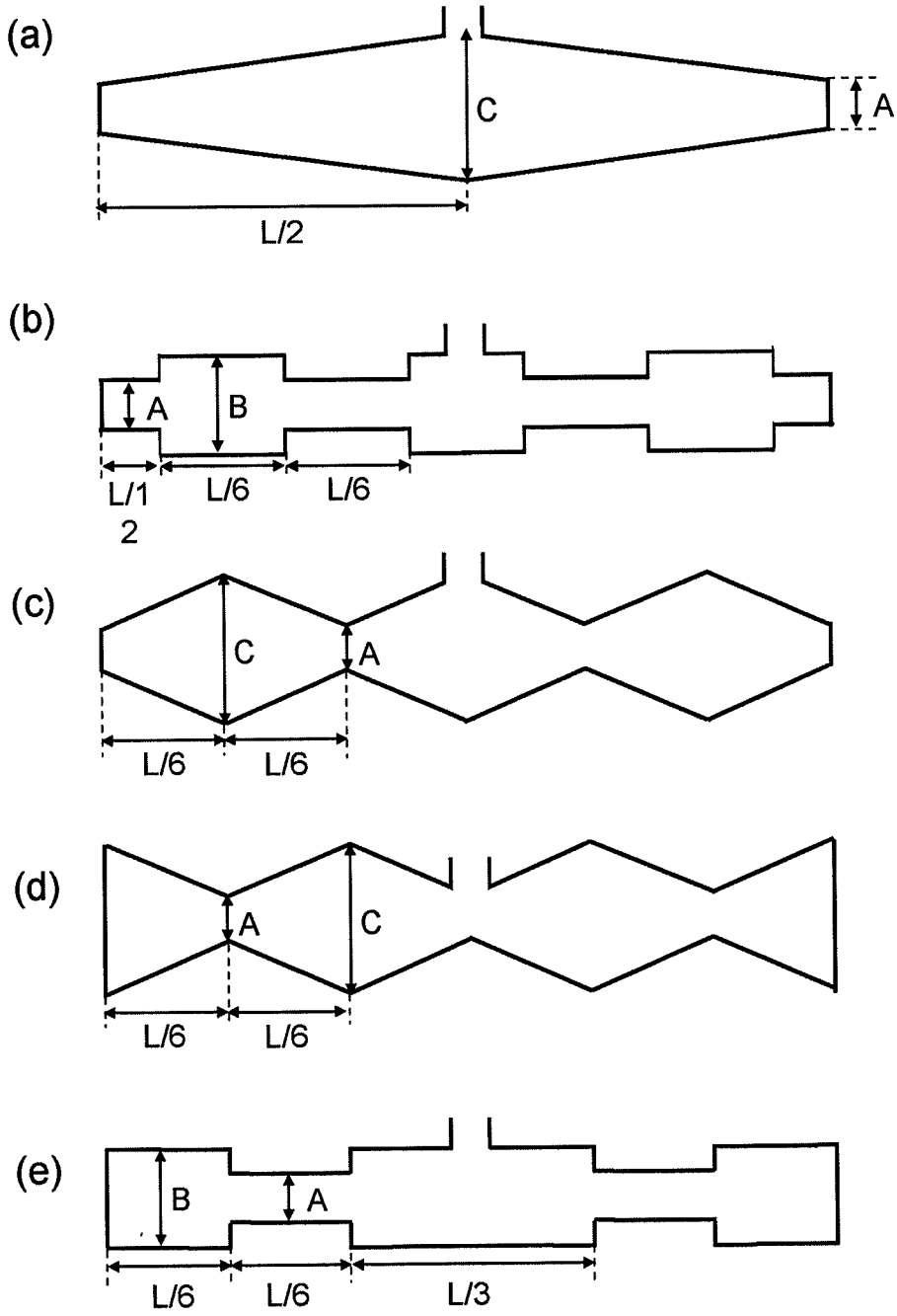
FIGS. 20(*a*) to 20(*e*) are schematic diagrams showing shapes of the shared flow path of the liquid discharge head.

FIGS. 19(*a*) to 19(*f*) and FIGS. 20(*a*) to 20(*e*) are schematic diagrams of the shared flow paths of the tested liquid discharge heads Nos. 201 to 211. Each of these shared flow paths has the same basic structure as the liquid discharge head body 513 shown in FIG. 15.

TABLE 3

| No. | Shape of Shared Flow Path | Resonant Frequency Primary | Secondary [kHz] | Tertiary | Discharge Speed Average | Max. [m/s] | Min. | (Max. − Min.)/ Average [%] |
|---|---|---|---|---|---|---|---|---|
| * 201 | FIG. 19(a) | 31.2 | 62.6 | 93.8 | 9.1 | 10.0 | 8.2 | 20% |
| 202 | FIG. 19(b) | 51.2 | 62.4 | 92.8 | 8.5 | 8.8 | 8.1 | 8% |
| 203 | FIG. 19(c) | 45.2 | 62.4 | 79.2 | 8.6 | 9.0 | 8.2 | 10% |
| 204 | FIG. 19(d) | 38.4 | 75.2 | 105.6 | 8.7 | 9.2 | 8.3 | 10% |
| 205 | FIG. 19(e) | 38.8 | 49.2 | 104.8 | 8.8 | 9.3 | 8.4 | 10% |
| 206 | FIG. 19(f) | 39.2 | 62.4 | 84.8 | 8.7 | 9.2 | 8.3 | 10% |
| 207 | FIG. 20(a) | 46.8 | 62.4 | 102.0 | 8.6 | 9.0 | 8.2 | 9% |
| * 208 | FIG. 20(b) | 22.8 | 42.4 | 133.6 | 8.5 | 9.8 | 7.2 | 31% |
| * 209 | FIG. 20(c) | 24.4 | 45.6 | 139.6 | 8.6 | 9.8 | 7.4 | 28% |
| * 210 | FIG. 20(d) | 24.4 | 45.6 | 54.8 | 8.6 | 9.8 | 7.4 | 28% |
| * 211 | FIG. 20(e) | 22.8 | 83.2 | 93.6 | 8.5 | 9.8 | 7.2 | 31% |

Mark * means out of the scope of the invention.

In the liquid discharge head of sample No. 201 with a constant cross-sectional dimension, the primary resonant frequency is 31.2 kHz, which is not so high with respect to the driving frequency 20 kHz. The discharge speed variation is as large as 20%. The discharge speed distribution of this liquid discharge head is that shown in FIG. 17(*a*), and the discharge speed has the periodic distribution as described earlier.

On the contrary, in the liquid discharge head of sample No. 202, the primary resonant frequency is 51.2 kHz, which is high with respect to the driving frequency. The discharge speed variation is extremely reduced to 8%. In the discharge speed distribution of this liquid discharge head, the periodic distribution of the speed is suppressed even in the 10th discharge, as shown in FIG. 17(*b*).

Thus, in the liquid discharge heads Nos. 202 to 207 of the present invention, the discharge speed variations could be mitigated by increasing the primary resonant frequency. It can be seen that the discharge speed variations are further mitigated as the primary resonant frequency becomes higher. From these results, the discharge speed variations can be reduced to 10% or less by setting the ratio of the driving frequency 20 kHz to the resonant frequency 38.4 kHz, namely, 0.53 times or less.

The shared flow paths of sample No. 208 and sample No. 209 are designed to increase the secondary and tertiary resonant frequencies. However, it can be seen that the primary resonant frequency is lowered, and therefore the discharge speed variations become large, thus exerting a large influence of the primary resonant frequency close to the high-order resonant frequency.

DESCRIPTION OF REFERENCE NUMERALS

1 printer
2 liquid discharge head
4, 304 path member
5, 205, 305, 405, 505 manifold (shared flow path and liquid supply path)
5*a*, 205*a*, 305*b*, 405*a*, 505*a*, 605*a* submanifold (shared flow path)
5*b* opening
5*c*, 205*c*, 405*c*, 605*c* liquid supply path
6, 506 individual supply path
8 liquid discharge pore
9, 309 liquid pressing chamber group
10, 210, 310, 410, 510 liquid pressing chamber
11*a*, 11*b*, 11*c*, 11*d* liquid pressing chamber row
12, 212, 312, 412, 512, 612 aperture
13, 513 liquid discharge head body
15*a*, 15*b*, 15*c*, 15*d* liquid discharge pore row
21, 321, 521 piezoelectric actuator unit
21*a* piezoelectric ceramic layer (diaphragm)
21*b* piezoelectric ceramic layer
22-31 plates
32 individual path
34 common electrode
35 individual electrode
36 connection electrode
50 displacement element (pressing part)
L length of submanifold (shared flow path)

What is claimed is:

1. A liquid discharge head, comprising:

a shared flow path which is long in one direction;

a liquid supply path which is connected to both ends of the shared flow path, and has a larger cross-sectional area than the shared flow path and supplies the shared flow path with liquid;

a plurality of liquid pressing chambers which are respectively connected to the shared flow path;

a plurality of liquid discharge pores which are respectively connected to a plurality of the liquid pressing chambers, and discharge the liquid; and a plurality of pressing parts for respectively pressing liquid in the plurality of liquid pressing chambers, and allowing the liquid to be discharged from the liquid discharge pores, wherein a cross-sectional area of a middle segment of the shared flow path is smaller than a cross-sectional area of each of both end segments thereof.

2. The liquid discharge head according to claim 1, wherein the cross sectional area of the shared flow path changes continuously.

3. The liquid discharge head according to claim 1, wherein when a length of the shared flow path is taken as L (mm), an average cross-sectional area of a segment of a length L/2 in a middle of the shared flow path is a half or less of an average cross-sectional area of a segment of a length L/4 from the both ends of the shared flow path.

4. The liquid discharge head according to claim 3, wherein the cross sectional area of the shared flow path changes continuously.

5. A liquid discharge device, comprising:

the liquid discharge head according to claim 1; and a control part for controlling driving of the plurality of pressing parts, wherein the control part controls the pressing parts so as to drive at a driving cycle of 0.53 times or less a vibration cycle wherein liquid in the shared flow path is subjected to a primary resonant vibration.

6. A recording apparatus, comprising:

the liquid discharge device according to claim 5; and a transport part for transporting a recording medium to the liquid discharge device.

7. A liquid discharge device, comprising:

the liquid discharge head according to claim 3; and a control part for controlling driving of the plurality of pressing parts, wherein the control part controls the pressing parts so as to drive at a driving cycle of 0.53 times or less a vibration cycle wherein liquid in the shared flow path is subjected to a primary resonant vibration.

8. A liquid discharge device, comprising:

the liquid discharge head according to claim 2; and a control part for controlling driving of the plurality of pressing parts, wherein the control part controls the pressing parts so as to drive at a driving cycle of 0.53 times or less a vibration cycle wherein liquid in the shared flow path is subjected to a primary resonant vibration.

* * * * *